US008764334B1

(12) United States Patent
Buckner et al.

(10) Patent No.: US 8,764,334 B1
(45) Date of Patent: Jul. 1, 2014

(54) SCRAPING APPARATUS FOR INTEGRATION WITH A PRESSURE WASHING WAND

(71) Applicants: Kenneth Buckner, Lake Worth, FL (US); Jason Boyle, Delray Beach, FL (US)

(72) Inventors: Kenneth Buckner, Lake Worth, FL (US); Jason Boyle, Delray Beach, FL (US)

( * ) Notice: Subject to any disclaimer, the term of this patent is extended or adjusted under 35 U.S.C. 154(b) by 0 days.

(21) Appl. No.: 13/655,247

(22) Filed: Oct. 18, 2012

Related U.S. Application Data

(63) Continuation of application No. 12/432,398, filed on Apr. 29, 2009, now abandoned, which is a continuation-in-part of application No. 11/961,279, filed on Dec. 20, 2007.

(60) Provisional application No. 61/050,187, filed on May 2, 2008.

(51) Int. Cl.
*A47L 13/30* (2006.01)
*A47L 13/03* (2006.01)
*A47L 13/08* (2006.01)

(52) U.S. Cl.
CPC *A47L 13/03* (2013.01); *A47L 13/08* (2013.01)
USPC ..... 401/261; 401/265; 401/25

(58) Field of Classification Search
USPC ..... 401/25, 139, 261, 265, 266, 290; 15/256.5, 401, 236.01; 134/6, 145, 172
See application file for complete search history.

(56) References Cited

U.S. PATENT DOCUMENTS

| | | | | |
|---|---|---|---|---|
| 1,598,811 | A * | 9/1926 | Ferrin | 401/263 |
| 2,443,602 | A * | 6/1948 | Clark | 15/401 |
| 5,116,152 | A * | 5/1992 | Caswell | 401/261 |
| 5,575,035 | A * | 11/1996 | Reis et al. | 15/324 |
| 6,120,205 | A * | 9/2000 | Larson | 401/261 |
| 6,258,177 | B1 * | 7/2001 | Eastman et al. | 134/6 |
| 6,601,266 | B1 * | 8/2003 | Faraci et al. | 15/401 |
| 7,927,033 | B2 * | 4/2011 | Gansebom et al. | 401/139 |
| 8,069,531 | B2 * | 12/2011 | Ruston | 15/401 |

* cited by examiner

*Primary Examiner* — David Walczak
*Assistant Examiner* — Jennifer C Chiang
(74) *Attorney, Agent, or Firm* — Gold & Rizvi, P.A.; Glenn E. Gold

(57) ABSTRACT

A scraping apparatus is secured to a wand of a pressure sprayer. The scraping apparatus includes a scraping blade, which is fastened to a spacing block. The assembly is secured to the wand via a clamping mechanism. The clamping mechanism can be of a quick release design. The rotating blade can be pivotally assembled to the block and held in position by any of a variety of designs. Alternately, a fluid conduit can be incorporated into a scraping block. The nozzle is secured to a scraping end of the block and the wand is secured to an opposing end providing fluid communication through the assembly.

20 Claims, 28 Drawing Sheets

SCRAPING APPARATUS FOR INTEGRATION WITH A PRESSURE WASHING WAND

CROSS-REFERENCE TO RELATED APPLICATION

This application is a Continuing Prosecution Application claiming the benefit of U.S. Non-Provisional patent application Ser. No. 12/432,398, filed on Apr. 29, 2009, which claims benefit of U.S. Non-Provisional patent application Ser. No. 11/961,279, filed on Dec. 20, 2007, which is a Continuation-In-Part of co-pending non-provisional patent application Ser. No. 11/961,279, filed on Dec. 20, 2007, and also claims the benefit of U.S. Provisional Patent Application Ser. No. 61/050,187, filed on May 2, 2008, all of which are incorporated herein in their entireties.

BACKGROUND OF THE INVENTION

1. Field of the Invention

The present invention relates generally to scraping devices. More particularly, the present application involves a scraping device for use with a pressure washing wand.

2. Discussion of the Related Art

Deloe (U.S. Pat. No. 5,477,583) discloses a device for cleaning mowing machinery, which is adapted for connection to the end of a hose to receive a pressurized supply of water. The device includes a tube, a channel passage for the pressurized water, a connector for connecting one end of the tube to the hose, and a scraper element disposed at the other end of the tube. The scraper element has a base section, a hose-like neck section, and a water outlet positioned over the base section. The scraper incorporates an angle between the wand pipe extension, the wand, and the scraper. Deloe is limited in that Deloe requires the wand to be incorporated into the scraper section of the device in order to accommodate the angle. Additionally, the scraping design is specific to the pressure wand.

Caswell (U.S. Pat. No. 5,116,152) discloses an apparatus wherein a fluid nozzle is arranged with a valve figure to affect fluid flow through the nozzle, wherein the nozzle includes a scraper blade mounted within the housing to permit reciprocation of the scraper blade from a first position to a second position extended forwardly of the wand to permit simultaneous scraping and cleaning. Caswell is limited in that the scraper is fastened to the housing in a manner to be reciprocating. Caswell's design requires a custom housing for the wand to accommodate the scraper, wherein the design is not conducive to an aftermarket product.

Halko (U.S. Pat. No. 5,685,251) discloses a water jet powered boat bottom cleaning system which removes barnacles and other accumulated debris from a boat bottom by applying an upward force from a buoyant boule-shaped member coupled with the force exerted by a plurality of water jets to an interchangeable scraper blade during reciprocating movement caused by the user. Halko orients the scraper perpendicular to the handle portion. Halko is limited in the design to accommodate the various forces. The water jets are designed to discharge away from the end of the interchangeable scraper blade (col 4, Lines 41-42).

The high pressure cleaning process projects a fluid (generally water) with a significant force towards an object and, as with all physics, an equal and opposite force of the handle in an equal and opposite direction.

There are many high pressure cleaning devices available. What is lacking is a scraping device that can be secured to the currently available high pressure cleaning devices without requiring modifications to the high pressure cleaning devices, yet sturdy enough to withstand the forces exerted during scraping.

Ideally, a scraping device that can be coupled to a standard pressure cleaning device is desired.

SUMMARY OF THE INVENTION

The present invention is directed to a scraping apparatus designed to be secured to a wand section of a commonly available pressure cleaning wand.

A first aspect of the present invention is a scraper including a scraping blade, a spacer block, and a wand coupling mechanism.

Yet another aspect of the present invention incorporates a friction-increasing feature on a wand contacting side section of the wand coupling mechanism.

Yet another aspect incorporates a quick release design for the wand coupling mechanism.

Yet another aspect incorporates a wand coupling mechanism comprising a pair of threaded members, one member having standard threading, the second having reverse threading.

Yet another aspect incorporates a wand coupling mechanism comprising a hinged clamping bracket, the clamping bracket being hinged on a first side and having a latching fastener on the second side. One such latching fastener can be a threaded design.

Yet another aspect incorporates a wand coupling mechanism comprising a "V" shaped wand-receiving section.

Yet another aspect incorporates a scraping blade having a first scraping edge and an opposing scraping edge.

Yet another aspect incorporates a scraping blade having a first scraping edge with a first scraping width and an opposing scraping edge having a second scraping width, wherein the first scraping width differs from the second scraping width.

Yet another aspect provides a reversible blade, wherein the reversible blade pivots about a central pivot point.

Yet another aspect provides a reversible blade, wherein the reversible blade is locked into usable configuration.

Yet another aspect locks the reversible blade via a threaded fastener.

Yet another aspect locks the reversible blade via at least one rotating blade securing latch.

Yet another aspect locks the reversible blade via a hook and latch mechanism.

Yet another aspect utilizes all non-corrosive materials in the construction of the present invention.

In another exemplary embodiment, another aspect of the present invention provides a scraping block comprising a pressure flow port which provides fluid communication between the wand and the nozzle.

While another aspect of the present invention provides a means for interchanging nozzles at a flow exiting end of the scraping block.

These and other features, aspects, and advantages of the invention will be further understood and appreciated by those skilled in the art by reference to the following written specification, claims, and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the various views of the drawings.

DETAILED DESCRIPTION OF THE PREFERRED EMBODIMENT

Figure 1:
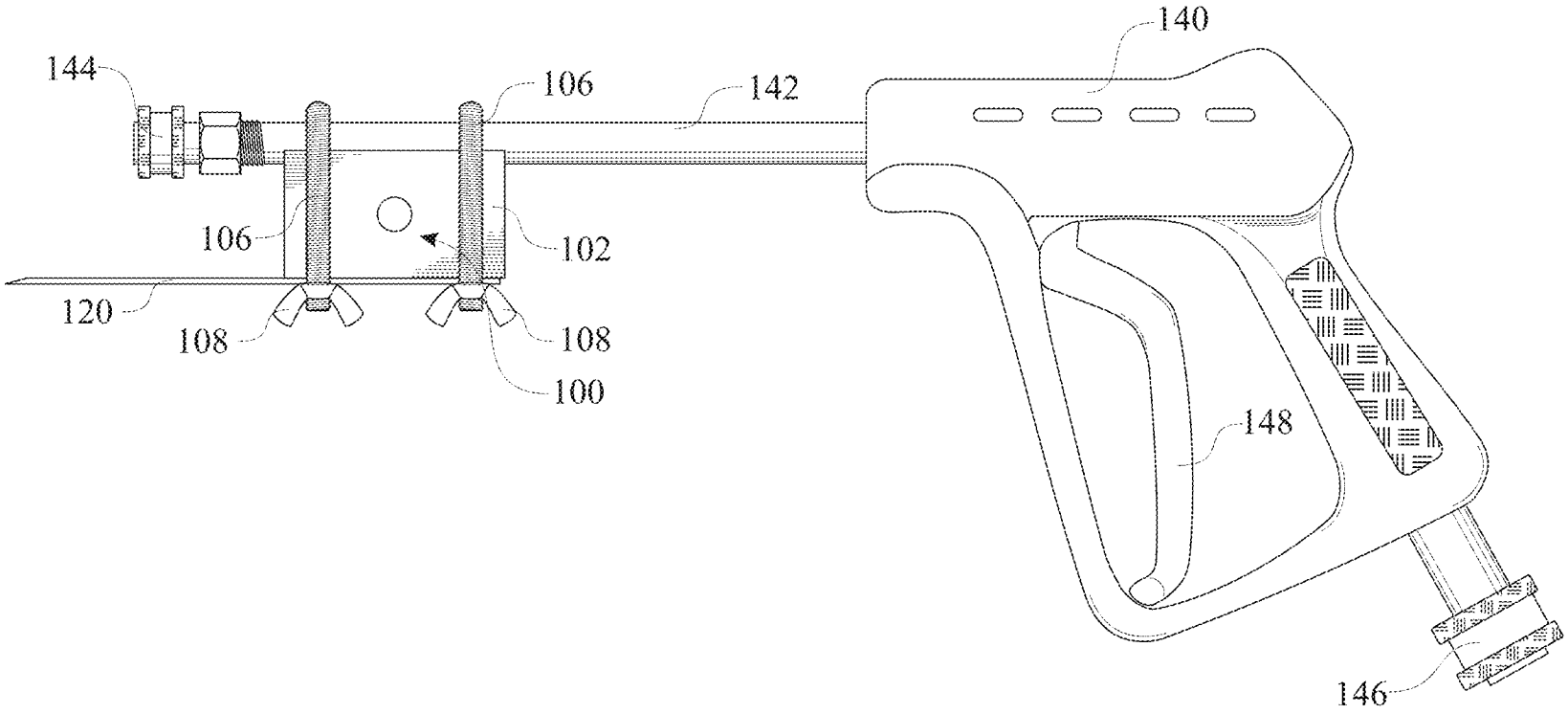
FIG. 1 is an elevation, side view of a prototype pressure cleaner scraper assembled to a pressure cleaner wand.
Figure 2:
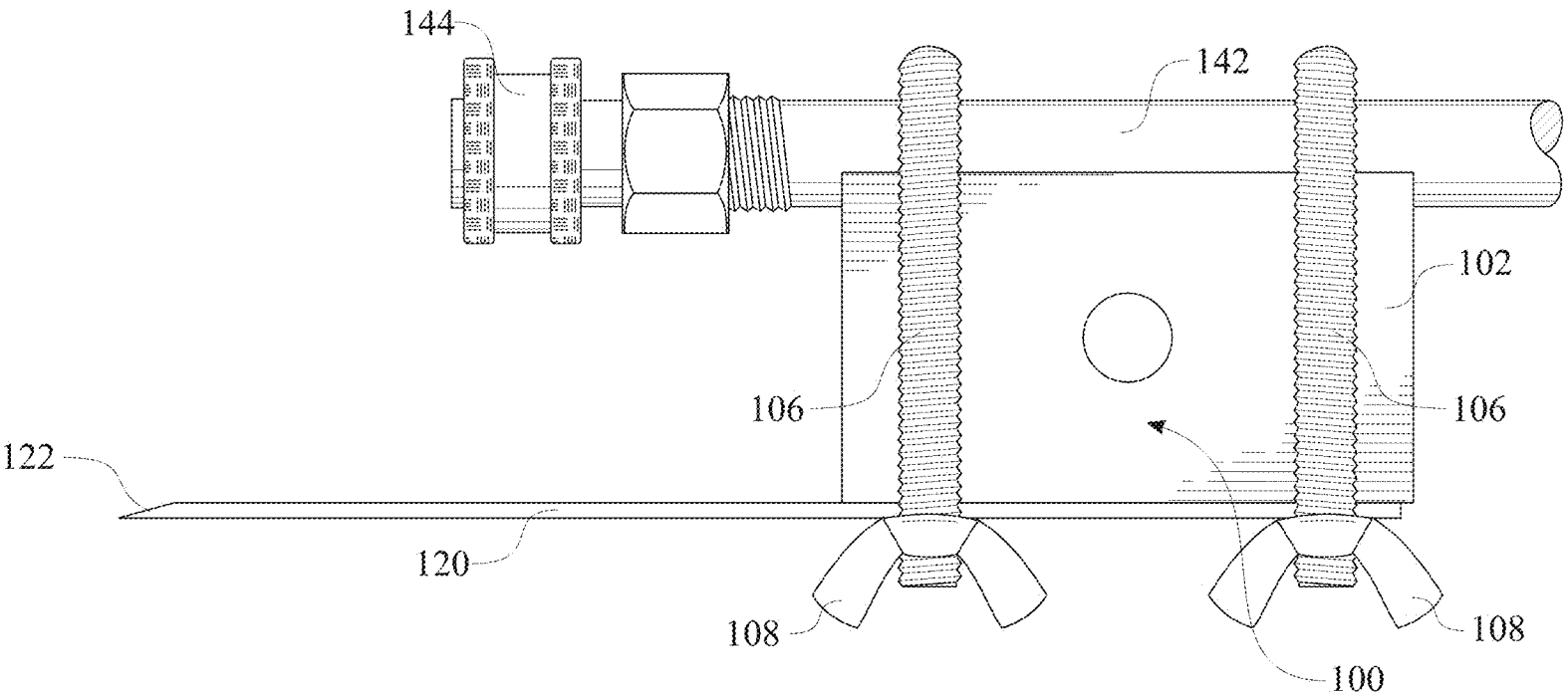
FIG. 2 is a magnified view of the prototype pressure cleaner scraper as presented in FIG. 1.
Figure 4:
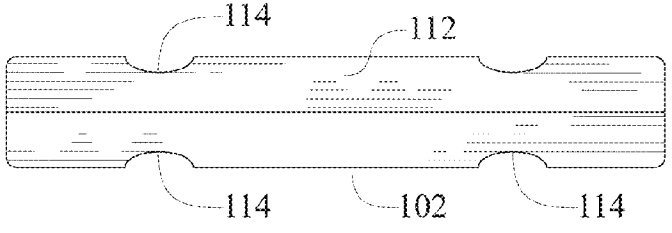
FIG. 4 is a top view of a spacer block of FIG. 3 utilized in the prototype pressure cleaner scraper.
Figure 6:
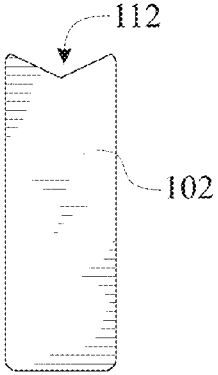
FIG. 6 is an end view of a spacer block of FIG. 3 utilized in the prototype pressure cleaner scraper.
Figure 3:
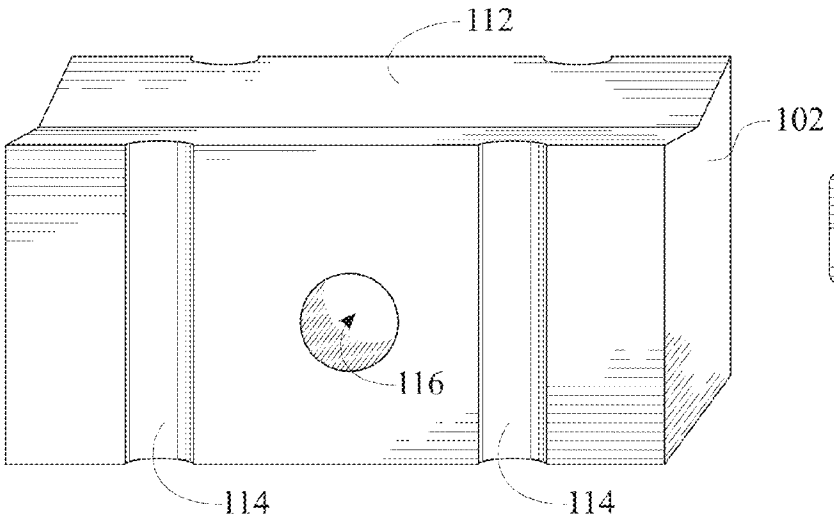
FIG. 3 is a perspective view of a spacer block utilized in the prototype pressure cleaner scraper.
Figure 5:
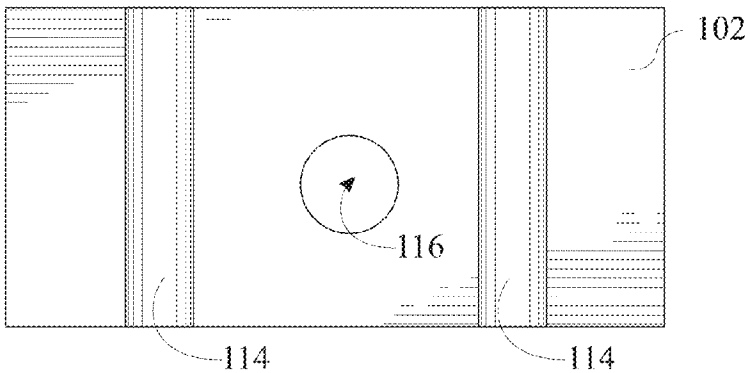
FIG. 5 is a side view of a spacer block of FIG. 3 utilized in the prototype pressure cleaner scraper.
Figure 7:
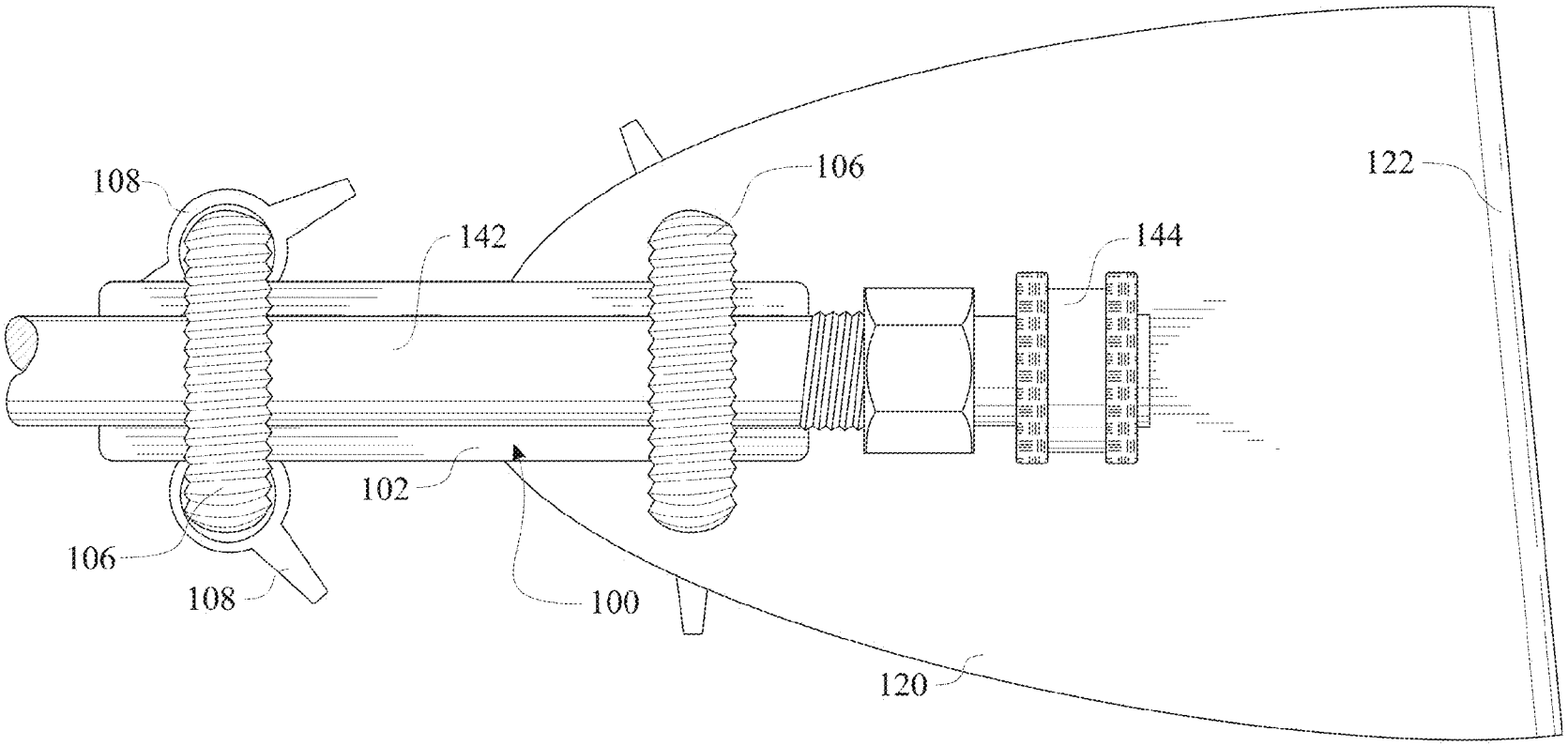
FIG. 7 is a magnified top view of the prototype pressure cleaner scraper as presented in FIG. 1.
Figure 8:
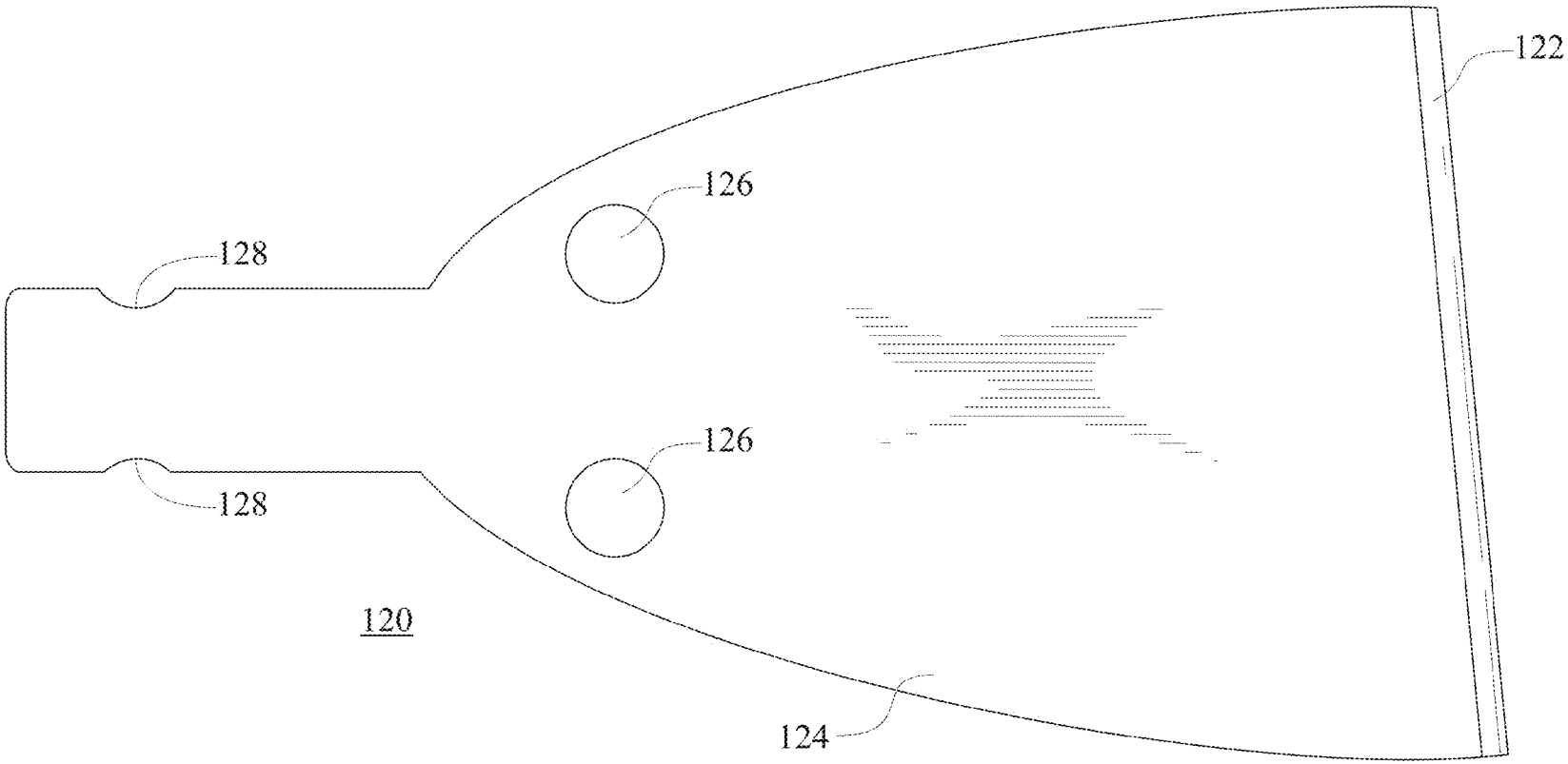
FIG. 8 is a top view of a single-edge scraping blade utilized in the prototype pressure cleaner scraper of FIG. 1.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIGS. 1 through 8 present various views of a pressure cleaning wand and scraping apparatus 100 in accordance with the invention. The pressure wand and scraping apparatus 100 is designed to be securely fastened to a pressure sprayer extension pipe 142 of any commonly sold pressure sprayer assembly. The pressure sprayer assembly comprises a pressure sprayer handle 140, the pressure sprayer handle 140 having a pressure source coupler 146 for fluidly coupling to a fluid pressure source, a spray trigger 148 for controlling the flow of the pressurized water, and a spray nozzle 144 fluidly coupled to the pressure sprayer handle 140 via the pressure sprayer extension pipe 142. The prototype pressure wand and scraping apparatus 100 couples a scraping blade 120 to a pressure sprayer extension pipe 142 via a pair of scraper to wand securing clamps 106. The scraping blade 120 is secured to a scraping apparatus spacer block 102. The scraping apparatus spacer block 102 provides a distance and desired angle between the pressure sprayer extension pipe 142 and scraping blade 120, resulting in a span between the discharged water spray and a blade edge 122 of the blade spatula section 124 of scraping blade 120. The scraping apparatus spacer block 102 has a main body including a sprayer pipe-receiving surface 112 along the top surface. The preferred pipe receiving surface 112 is in the shape of a "V" to provide the optimal shape for applying a clamping force onto the pressure sprayer extension pipe 142. This accommodates the range of diameters of the commercially offered pressure sprayer extension pipes 142. The scraper to wand securing clamps 106 are placed straddling the pressure sprayer extension pipe 142 with each side being positioned against a clamp clearance groove 114 of the scraping apparatus spacer block 102, then passing through either blade mounting apertures 126 or blade mounting notches 128 within the scraping blade 120. A female fastener 108 is then threaded to each end of the scraper to wand securing clamp 106 and subsequently tightened to apply a clamping force to the pressure sprayer extension pipe 142. The scraper to wand securing clamp 106, being a threaded rod, utilizes the threading to provide a textured surface disposed upon the receiving surface of the pressure sprayer extension pipe 142. The textured surface increases the friction between the scraper to wand securing clamp 106 and the pressure sprayer extension pipe 142, thus reducing any risk of slippage between the two components. The scraping apparatus spacer block 102 can additionally include at least one block aperture 116 to reduce the overall weight of the apparatus. The block aperture 116 can be designed in any shape, as long as the shape does not negatively impact the structural integrity of the overall apparatus.

Figure 9:
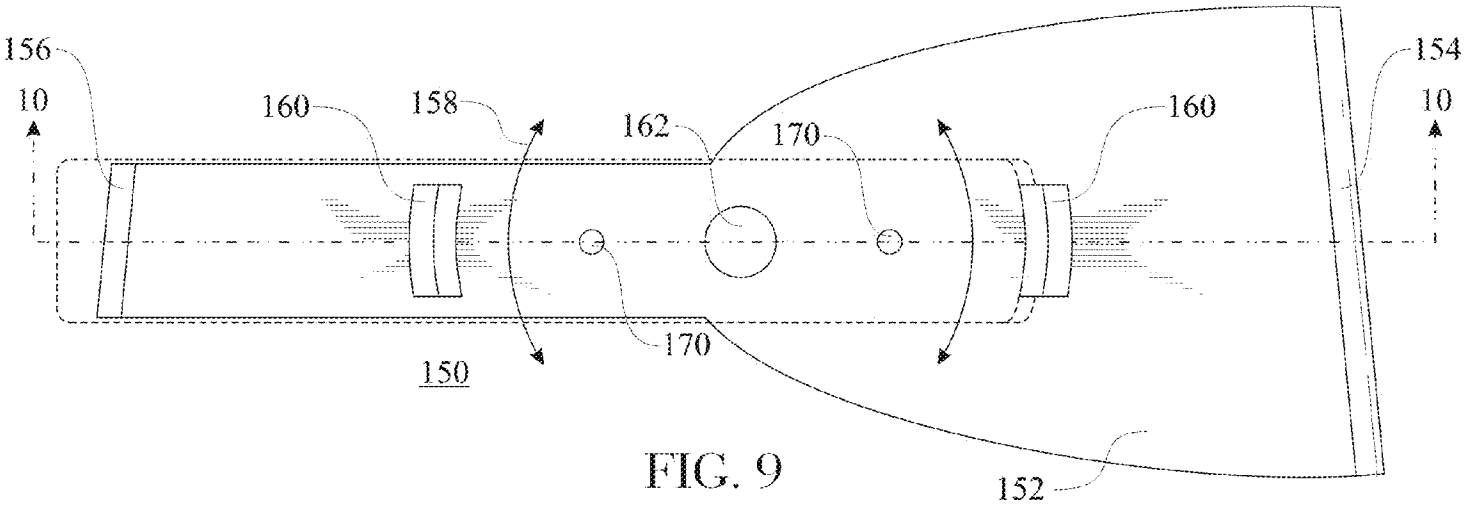
FIG. 9 is a top view of a rotating, dual-edged scraping blade.
Figure 10:
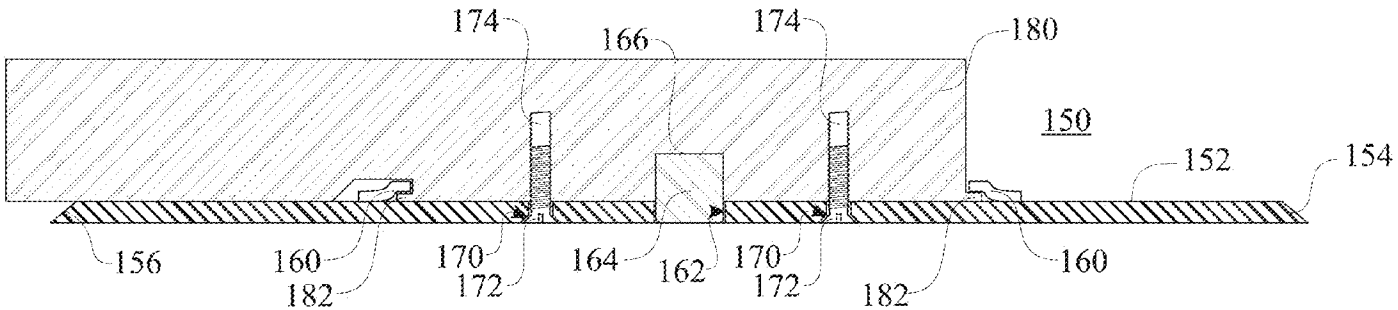
FIG. 10 is a sectional side view of the rotating, dual-edged scraping blade configuration taken along sectioning line 10-10 of FIG. 9.

The present invention can include a dual-edged blade 152, incorporated into a rotating dual-edged blade assembly 150 as presented in several exemplary embodiments illustrated in FIGS. 9 through 31. The dual-edged blade 152 comprises a first edge blade along a first edge of the blade 152 and a second edge blade located along a second edge of the blade 152, wherein the first edge and the second edge are on opposing ends of the blade 152. A first embodiment, as shown in FIGS. 9 and 10 assembles the dual-edged blade 152 to a pivot spacer block 180, wherein the dual-edged blade 152 pivots about a pivot axle 164, being secured into the desired orientation via a rotational locking design. The rotational locking design presented utilizes a pair of threaded securing members 172. The dual-edged blade 152 can have two different sized edges, such as a wide blade edge 154 and a narrow blade edge 156. It is desirable to be able to quickly convert from an edge of one width to an edge of a different width. Another desired feature is an assembly having a substantially flat or smooth bottom surface. The first embodiment illustrated accomplishes both features as follows: The pivot axle 164 is press fit into a block pivot sleeve 166 within the pivot spacer block 180 to a distance such that the pivot axle 164 does not project beyond the bottom of the double ended blade 152. The dual-edged blade 152 is assembled to the rotating double-ended blade assembly 150, placing the exposed portion of the pivot axle 164 through a blade pivot aperture 162 of the dual-edged blade 152. The dual-edged blade 152 is pivotally held against a bottom of the pivot spacer block 180 via at least one optional rotating blade guides 160 which interfaces with a respective spacer block pivot guides 182. It is recognized that many variations of the optional rotating blade guides 160 can be utilized and the shape presented is simply one example. A pair of threaded securing member 172 are inserted through a respective securing member aperture 170 of the dual-edged blade 152 and threaded into a block securing member sleeve 174 of the pivot spacer block 180. The user would unscrew the threaded securing member 172, rotate the dual-edged blade 152 via a pivoting motion 158, and re-secure the dual-edged blade 152 into the new position by re-inserting the threaded securing member 172.

Figure 11:
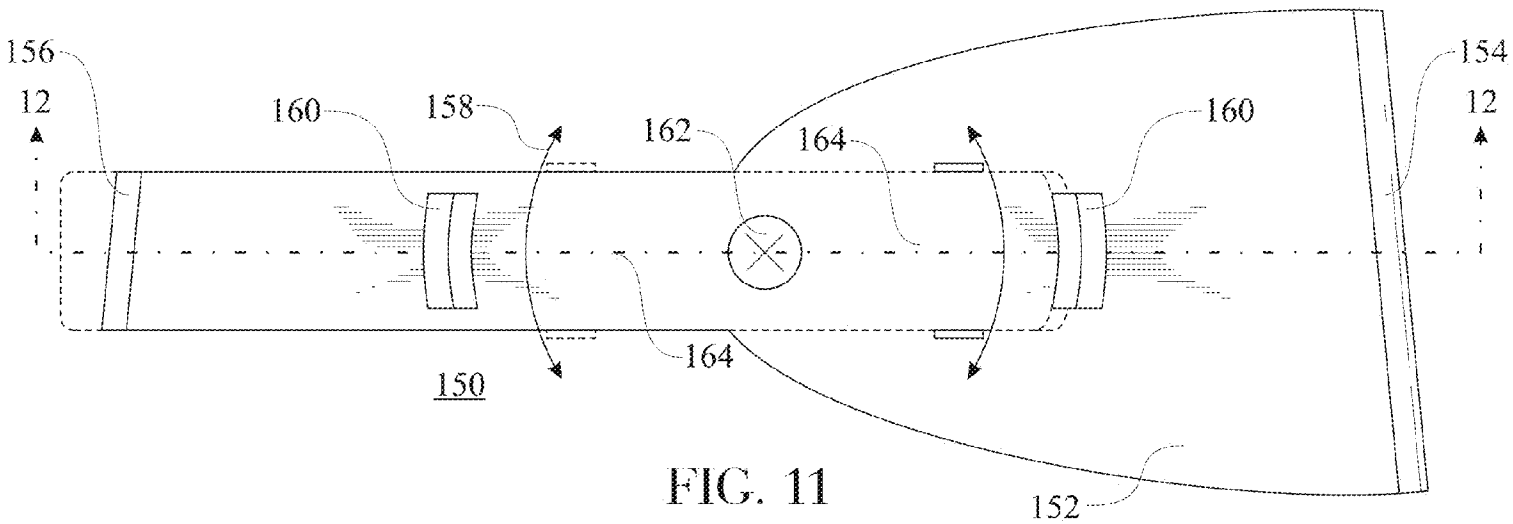
FIG. 11 is a top view of alternate embodiment of the rotating, dual-edged scraping blade of FIG. 9, presenting an anti-rotational swivel stop.
Figure 12:
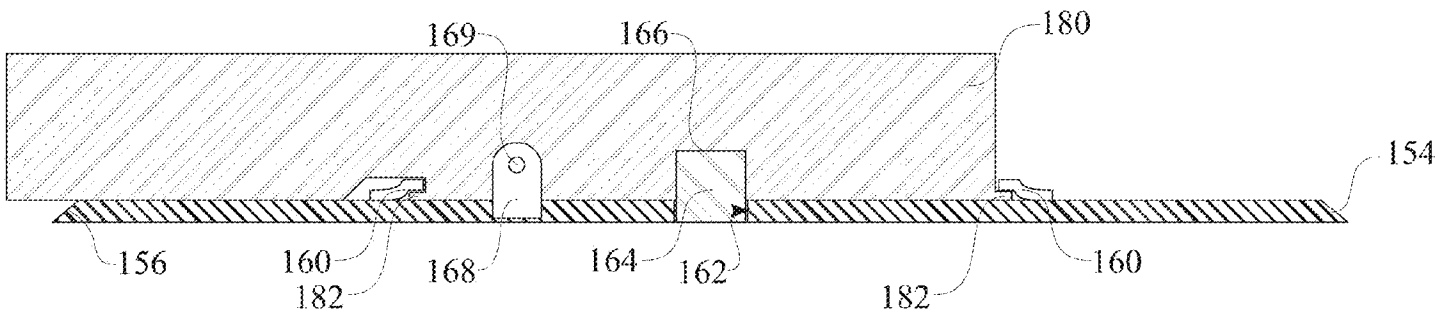
FIG. 12 is a sectional side view of the rotating, dual-edged scraping blade configuration taken along sectioning line—12-12 of FIG. 11.
Figure 13:
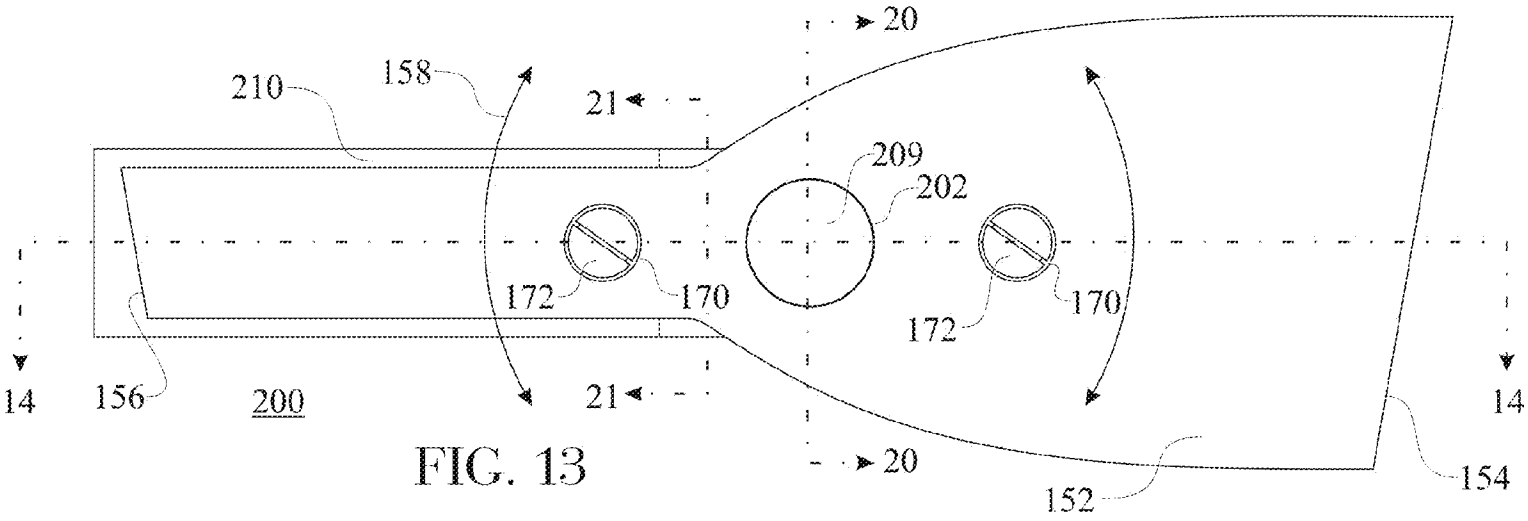
FIG. 13 is a bottom view of an alternate embodiment of the rotating, dual-edged scraping blade.
Figure 14:
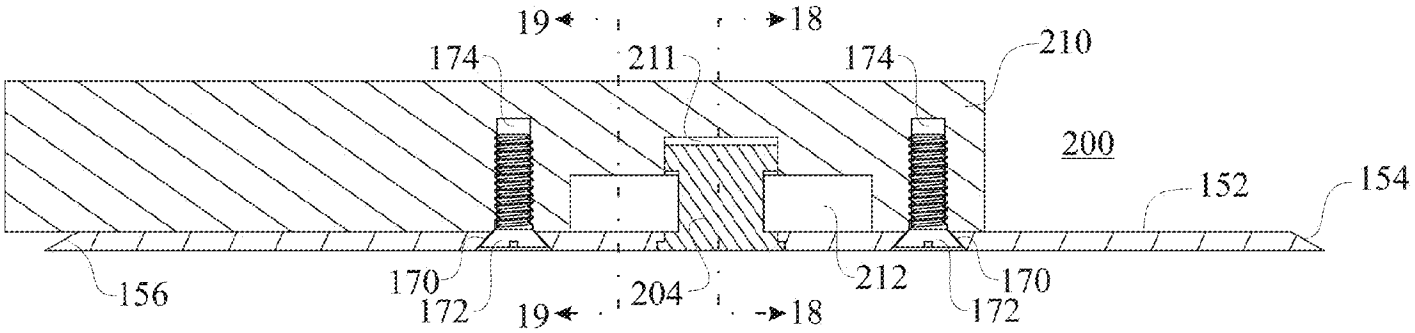
FIG. 14 is a sectional side view of the rotating, dual-edged scraping blade configuration taken along sectioning line—14-14 of FIG. 13.
Figure 15:
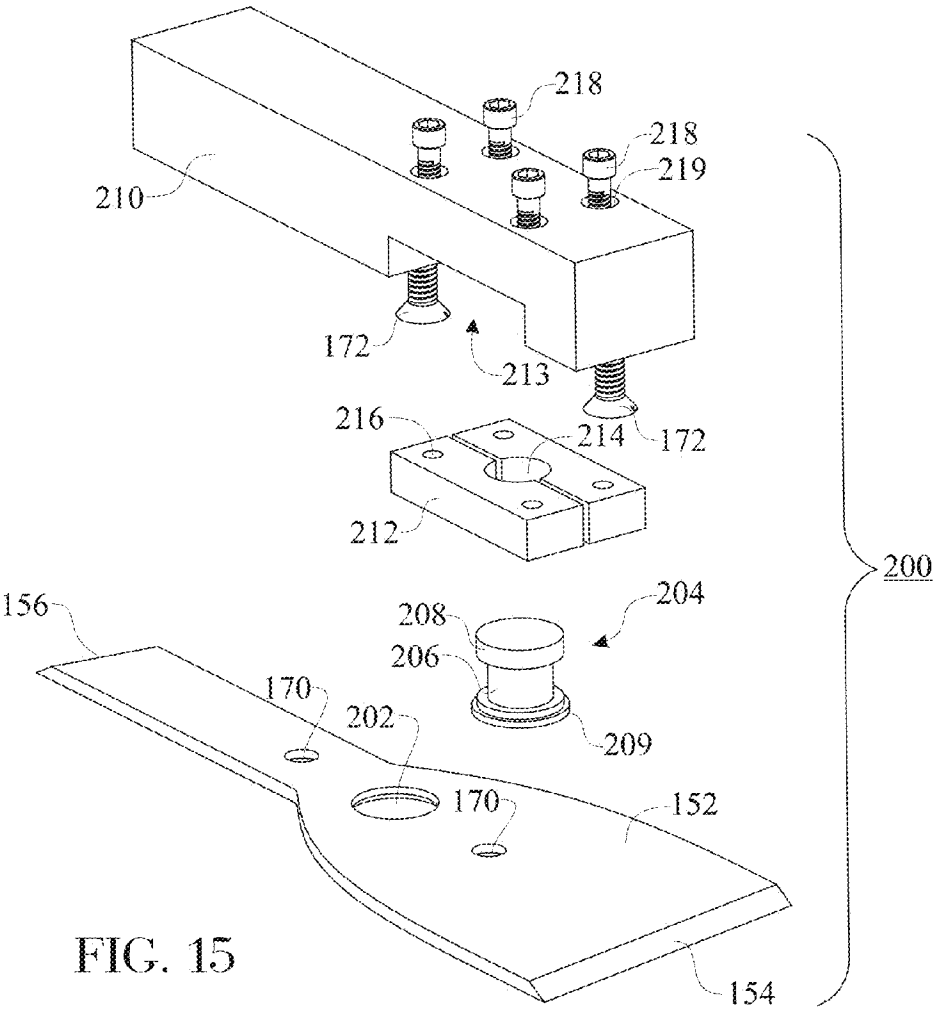
FIG. 15 is an isometric, exploded assembly view of the rotating, dual-edged scraping blade configuration of FIG. 13.
Figure 16:
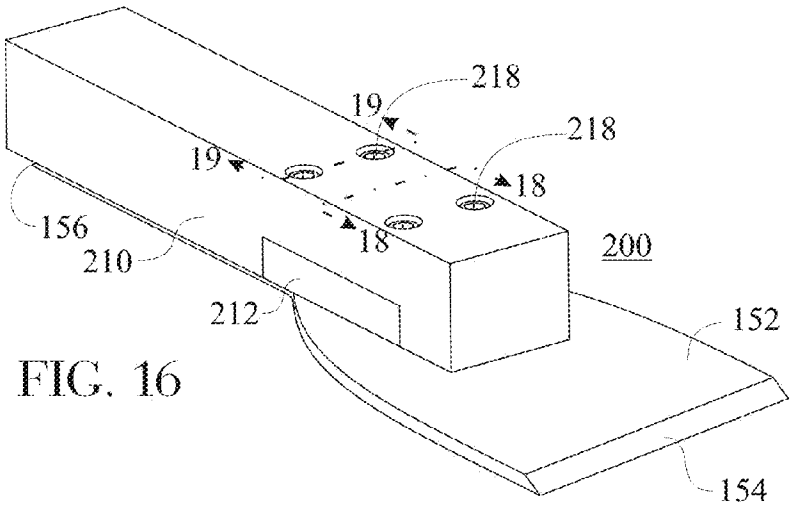
FIG. 16 is an isometric, top view of the rotating, dual-edged scraping blade configuration of FIG. 13.
Figure 17:
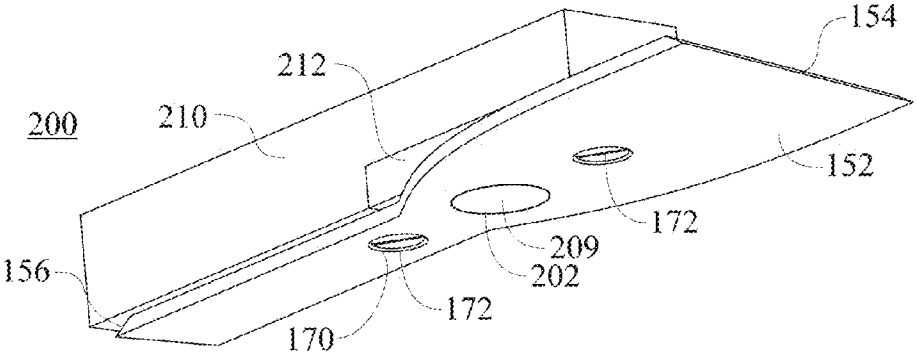
FIG. 17 is an isometric, bottom view of the rotating, dual-edged scraping blade configuration of FIG. 13.
Figure 18:
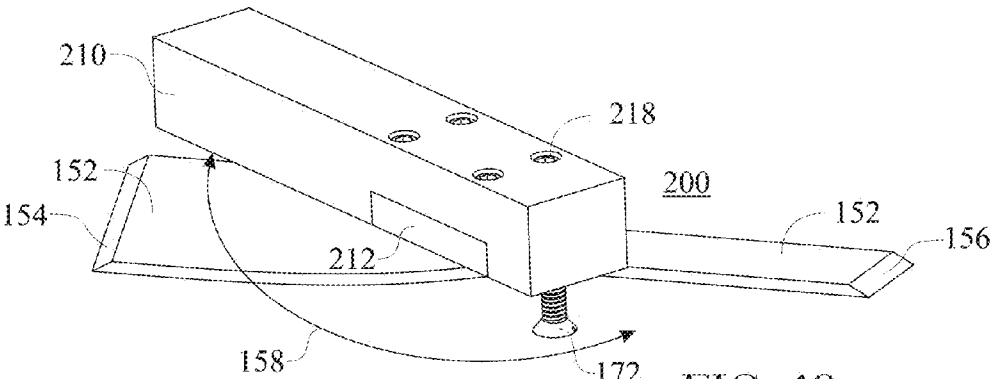
FIG. 18 is an isometric, top view of the rotating, dual-edged scraping blade configuration of FIG. 13, further illustrating a rotating motion of the dual-edged blade.
Figure 19:
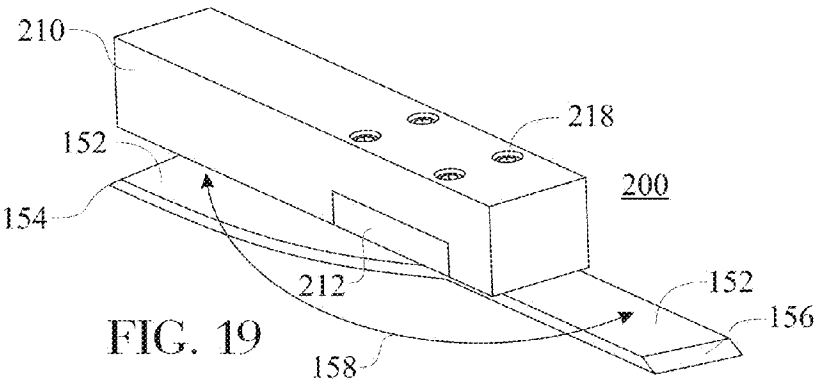
FIG. 19 is an isometric, top view of the rotating, dual-edged scraping blade configuration of FIG. 13, further illustrating the dual-edged, scraping blade in a fully rotated orientation.
Figure 21:
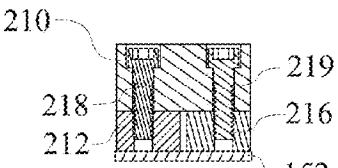
FIG. 21 is a sectional view through a pair of pivot axle mounting screws for the rotating, dual-edged scraping blade configuration taken along sectioning line 21-21 of FIG. 13.
Figure 20:
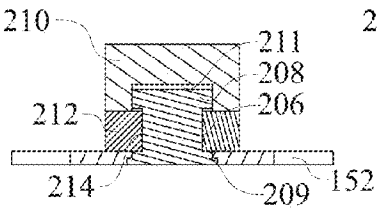
FIG. 20 is sectional view through a pivot axle for the rotating, dual-edged scraping blade configuration taken along sectioning line 20-20 of FIG. 13.
Figure 22:
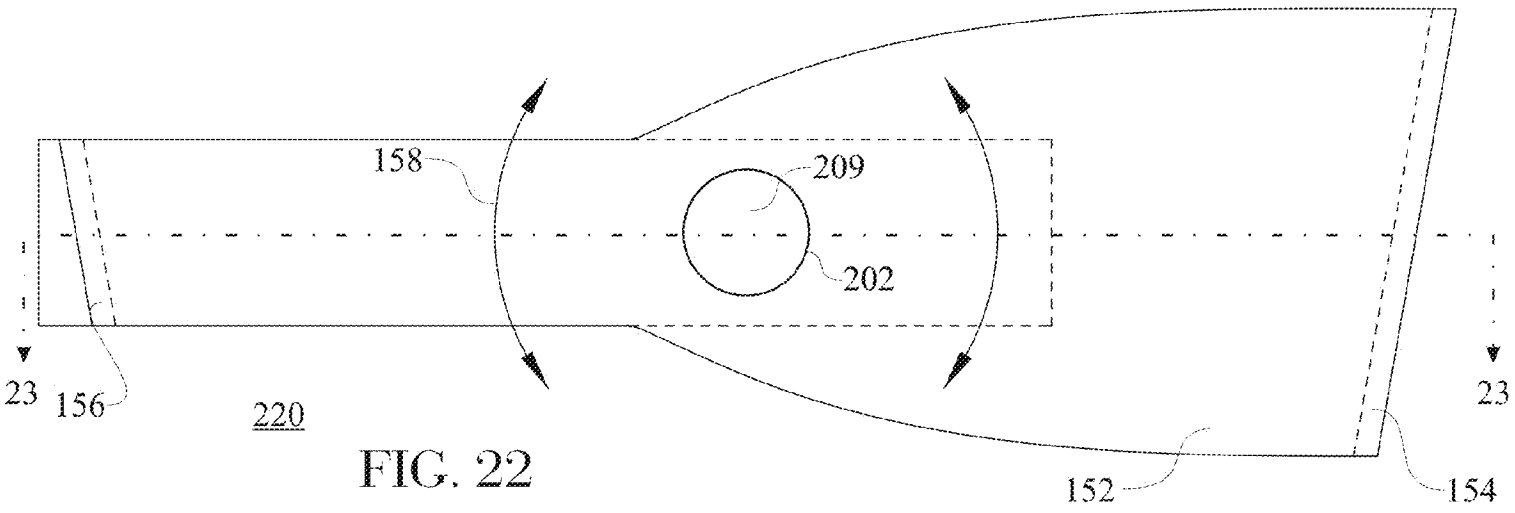
FIG. 22 is a bottom view of another alternate embodiment of the rotating, dual-edged scraping blade assembly.
Figure 23:
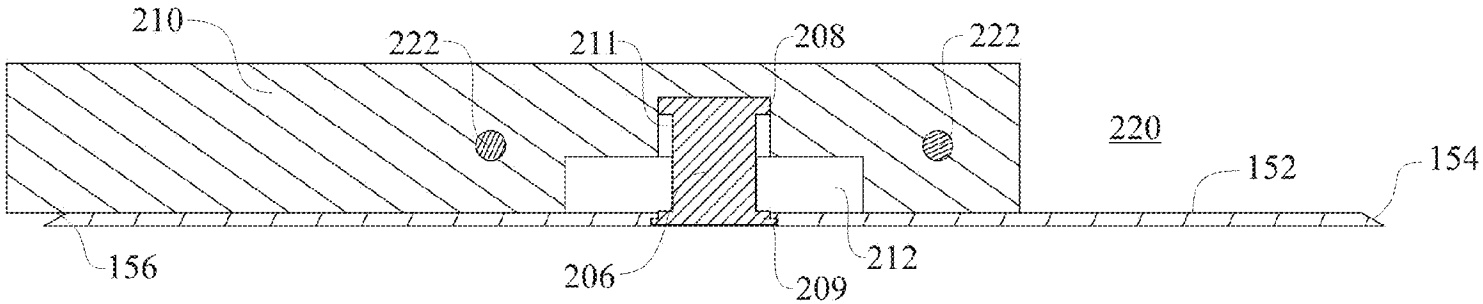
FIG. 23 is a sectional side view of the rotating, dual-edged scraping blade configuration taken along sectioning line 23-23 of FIG. 22.
Figure 24:
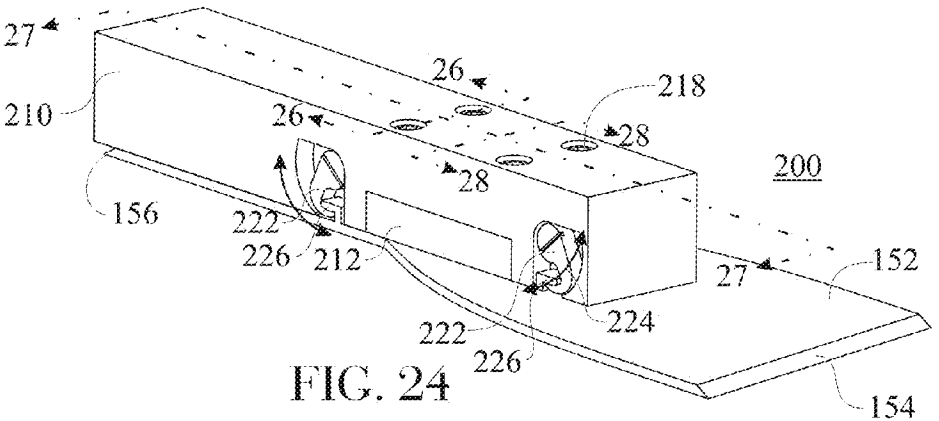
FIG. 24 is an isometric, top view of yet another rotating, dual-edged scraping blade configuration utilizing locking cams.
Figure 25:
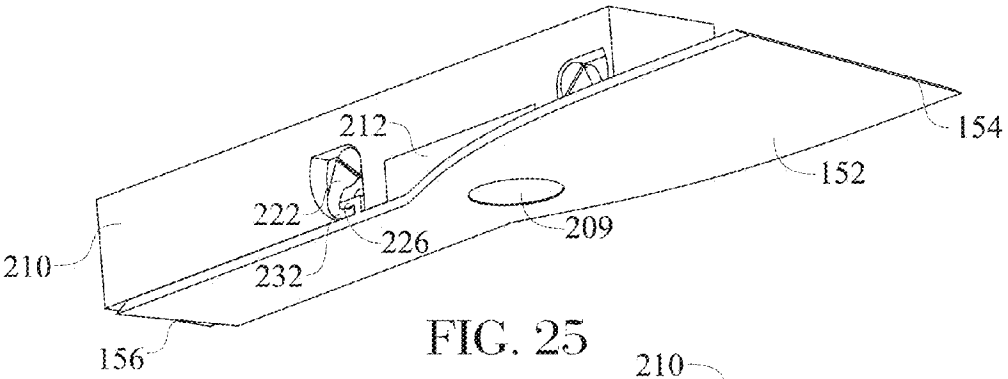
FIG. 25 is an isometric, bottom view of the rotating, dual-edged scraping blade configuration of FIG. 24.
Figure 26:
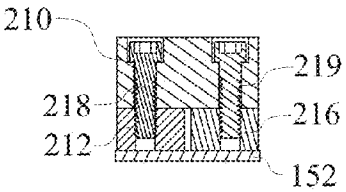
FIG. 26 is a sectional side view of the rotating, dual-edged scraping blade configuration taken along sectioning line 26-26 of FIG. 24.
Figure 27:
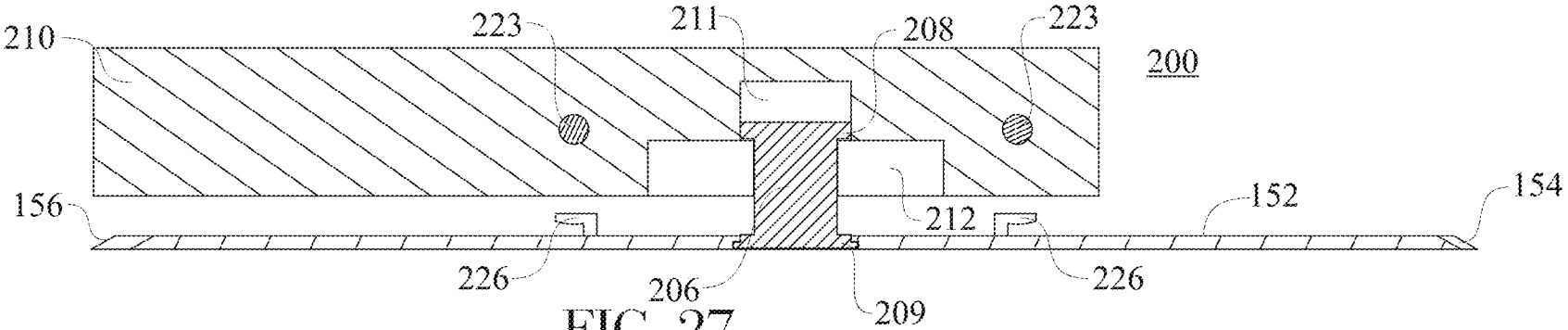
FIG. 27 is a sectional side view of the rotating, dual-edged scraping blade configuration taken along sectioning line 27-27 of FIG. 24.
Figure 29:
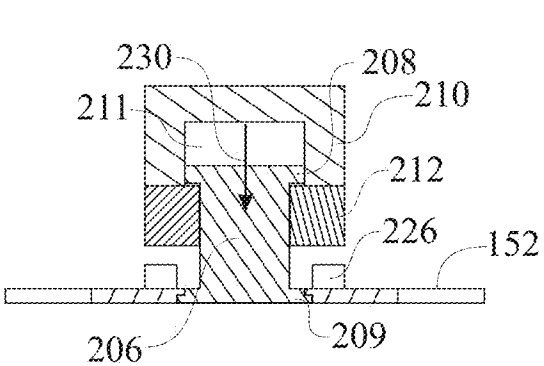
FIG. 29 is a sectional side view of the rotating, dual-edged scraping blade configuration taken along sectioning line 28-28 of FIG. 24, presenting the blade position when the cams are in a released state.
Figure 28:
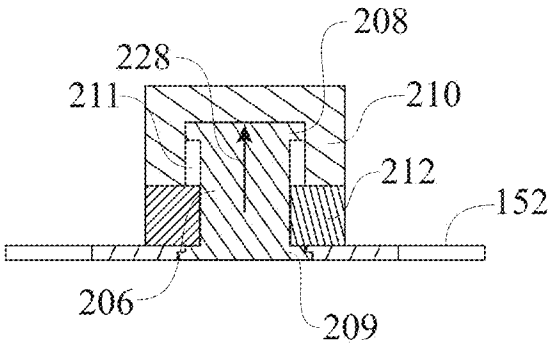
FIG. 28 is a sectional side view of the rotating, dual-edged scraping blade configuration taken along sectioning line 28-28 of FIG. 24, presenting the blade position when the cams are in a locked state.
Figure 30:
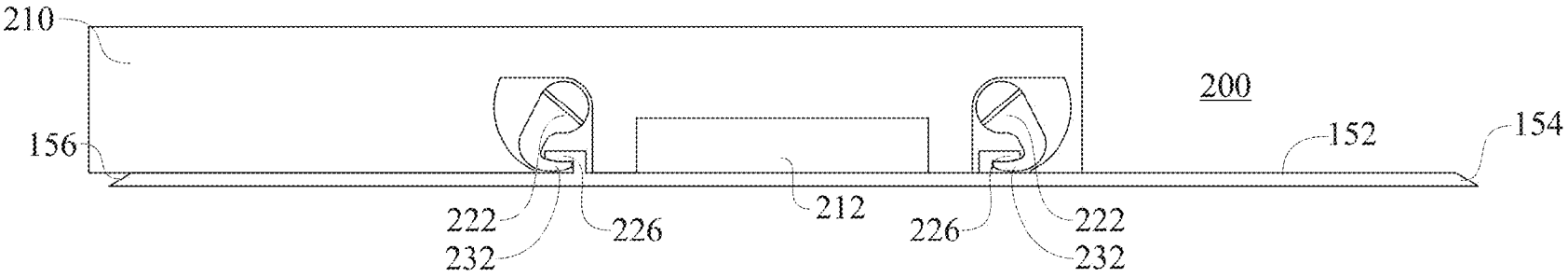
FIG. 30 is a side view of the rotating, dual-edged scraping blade configuration of FIG. 24.
Figure 31:
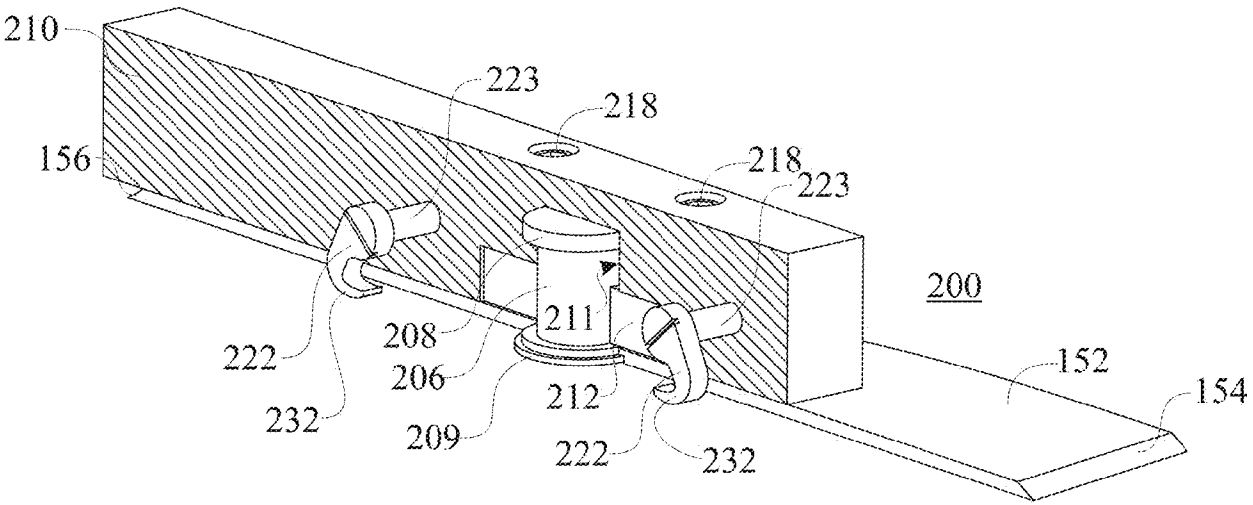
FIG. 31 is an isometric, sectional view of the rotating, dual-edged scraping blade configuration of FIG. 24 taken along sectioning line 27-27 illustrating the complete elements of the cams and pivot axle.

An alternate position securing design is illustrated in FIGS. 11 and 12. A plurality of rotating blade stop 168 is pivotally assembled to the pivot spacer block 180 via a rotating blade stop fastener 169. The rotating blade stop 168 would be rotated upward about the rotating blade stop fastener 169, providing clearance for the dual-edged blade 152 to pivot in accordance with a pivoting motion 158.

Yet, another embodiment is presented in FIGS. 13 through 21. A rotating dual-edged blade assembly 200 incorporates the same rotational locking design, while replacing the pivot axle 164 utilizing a dual function pivot axle design. The illustrated dual function pivot axle design of the rotating dual-edged blade assembly 200 utilizes a pivot axle spool 204, the pivot axle spool 204 having a spool axle section 206, spool block securing flange 208, and a spool blade securing flange 209. The spool blade-securing flange 209 is a countersunk style flange. The spool block securing flange 208 has a diameter that is equal to or smaller than a diameter of a countersunk pivot aperture 202, allowing the spool block securing flange 208 to be inserted through the countersunk pivot aperture 202 of the dual-edged blade 152. The countersunk pivot aperture 202 incorporates a countersunk edge for receiving the spool blade-securing flange 209. The pivot axle spool 204 is secured to a pivot spacer block 210 by placing a pivot axle-receiving collar 214 formed via a pair of pivot collar members 212 about the spool axle section 206. The pivot collar members 212 are then assembled to a collar receiving section 213 of the pivot spacer block 210 using a plurality of collar to block fasteners 218. The collar to block fasteners 218 are inserted through respective collar fastener apertures 219 of the pivot spacer block 210, then threaded into respective threaded securing members 216 of the pivot collar members 212. The spool block securing flange 208 is inserted into a block flange clearance 211 formed within the pivot spacer block 210. The user would unscrew the threaded securing members 172, rotate the dual-edged blade 152 via the pivoting motion 158, and re-secure the dual-edged blade 152 into the new position by re-inserting the threaded securing members 172. The dual-edged blade 152 is held against a bottom of the pivot spacer block 210 by the countersunk flange design of the spool blade-securing flange 209.

Yet, another embodiment is presented in FIGS. 22 through 31. A cam locking rotating blade assembly 220 incorporates a similar dual function pivot axle design as previously presented, utilizing a rotational locking design having cams 222 instead of locking screws 172. The dual-edged blade 152 incorporates a plurality of cam interfacing blade clips 226. The spool axle section 206 can be of a length and the block flange clearance 211 can have a depth allowing for a distance to be provided between a top of the dual-edged blade 152 and a bottom of the pivot spacer block 210 when the cams 222 are released. A plurality of cams 222 is pivotally assembled to the pivot spacer block 210 via a cam shaft 223. The user rotates the dual-edged blade 152 into the desired orientation via the pivoting motion 158. The user then rotates each of the cams 222 via a cam rotation 224, thus engaging the cam latching finger 232 with the blade clips 226 resulting in a upward locking motion 228. To rotate the dual-edged blade 152, the user releases the cams 222, disengaging the cam-latching finger 232 from the blade clips 226, resulting in a downward releasing motion 230. The blade clips 226 are lowered below the bottom of the pivot spacer block 210.

Figure 32:
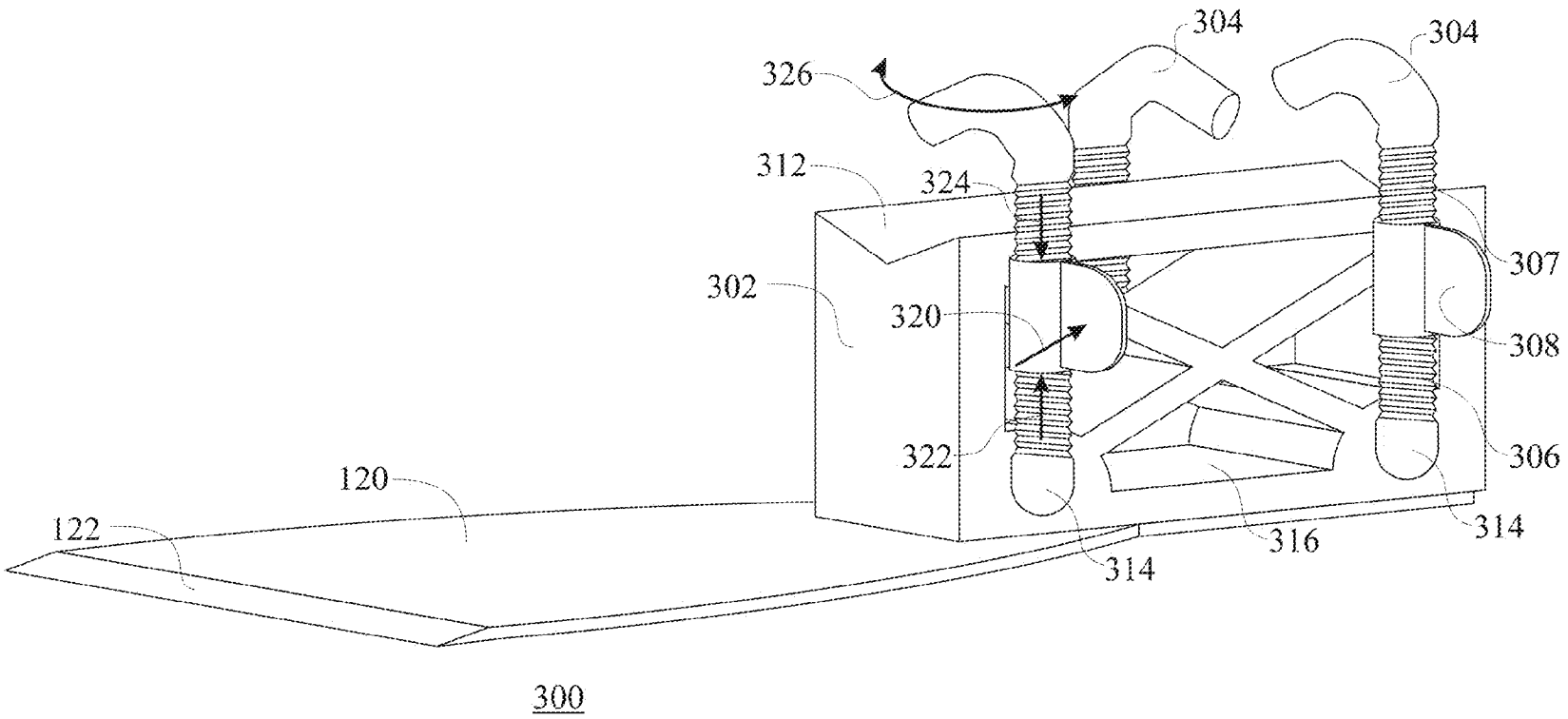
FIG. 32 presents an isometric view of a scraping blade assembly comprising a quick release wand coupling mechanism.
Figure 33:
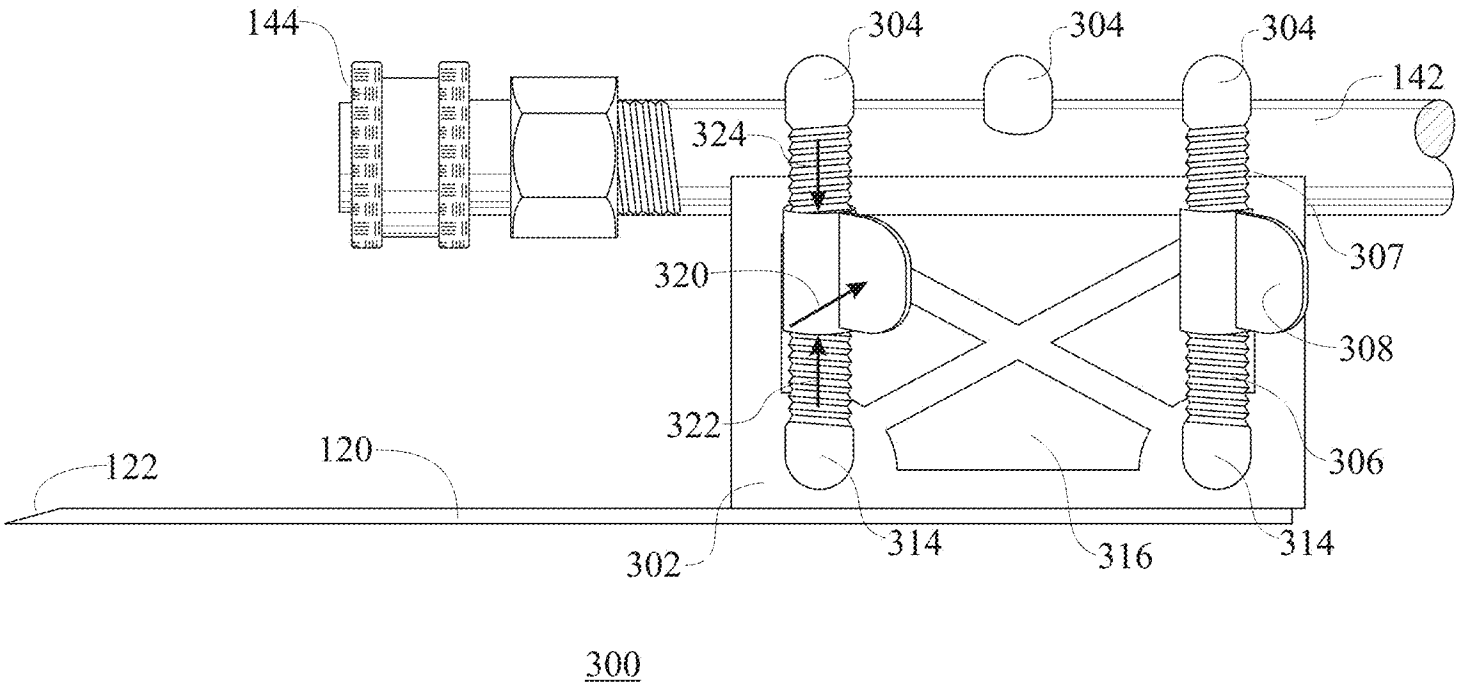
FIG. 33 presents a side view of the scraping blade assembly of FIG. 32.
Figure 34:
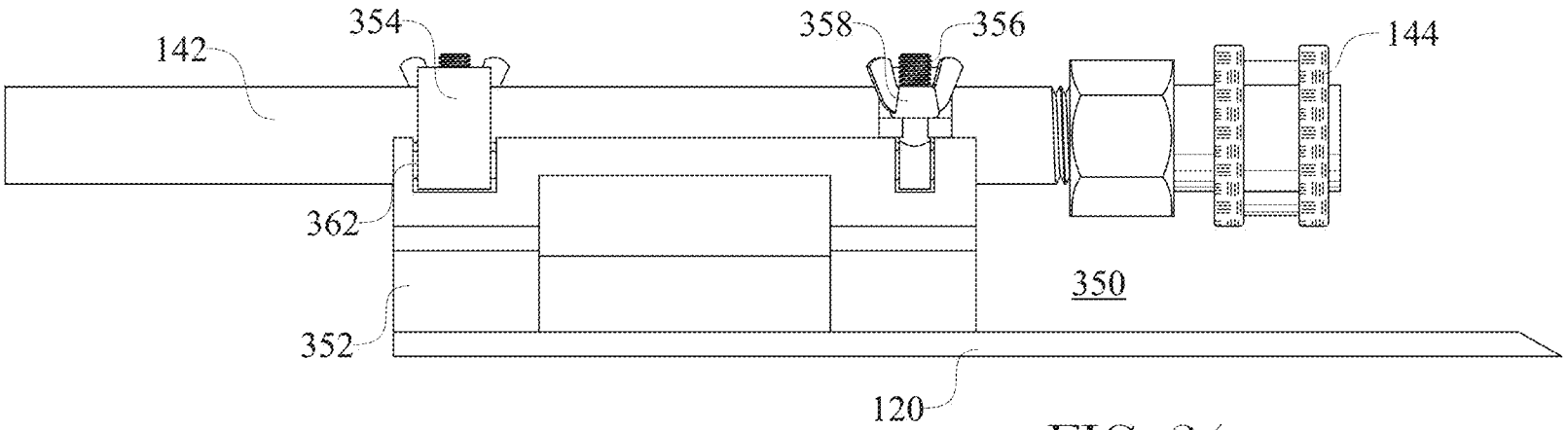
FIG. 34 is a side view of an scraping blade assembly comprising an alternate quick release wand coupling mechanism.
Figure 35:
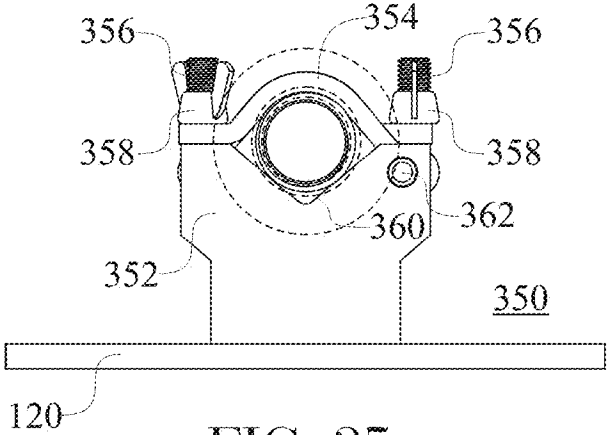
FIG. 35 presents a front view of the scraping blade assembly of FIG. 34.
Figure 36:
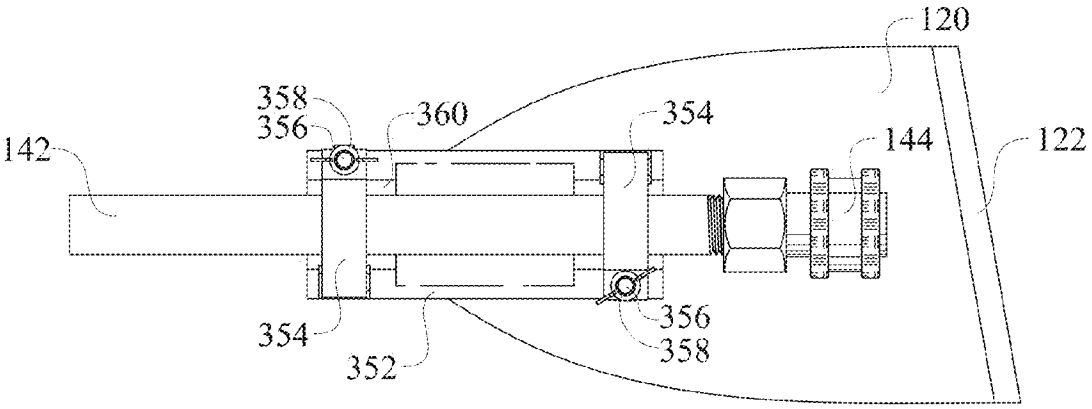
FIG. 36 presents a top view of the scraping blade assembly of FIG. 34.
Figure 37:
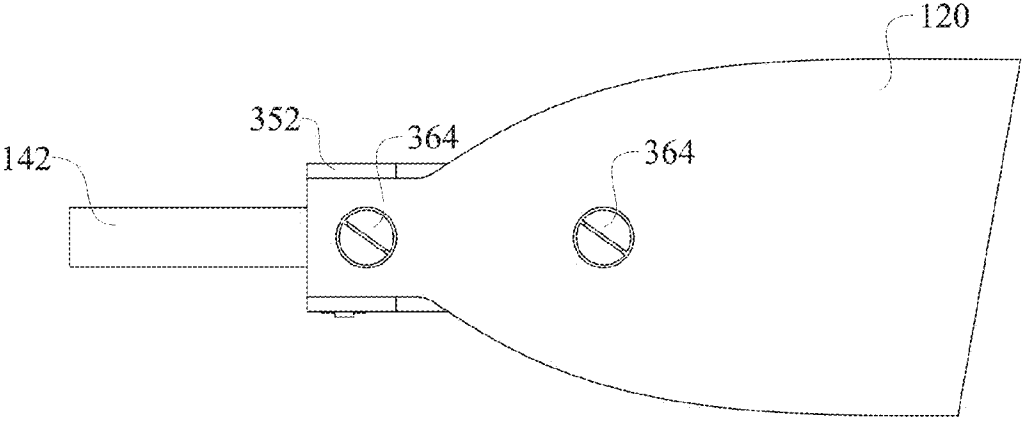
FIG. 37 presents a bottom view of the scraping blade assembly of FIG. 34.
Figure 38:
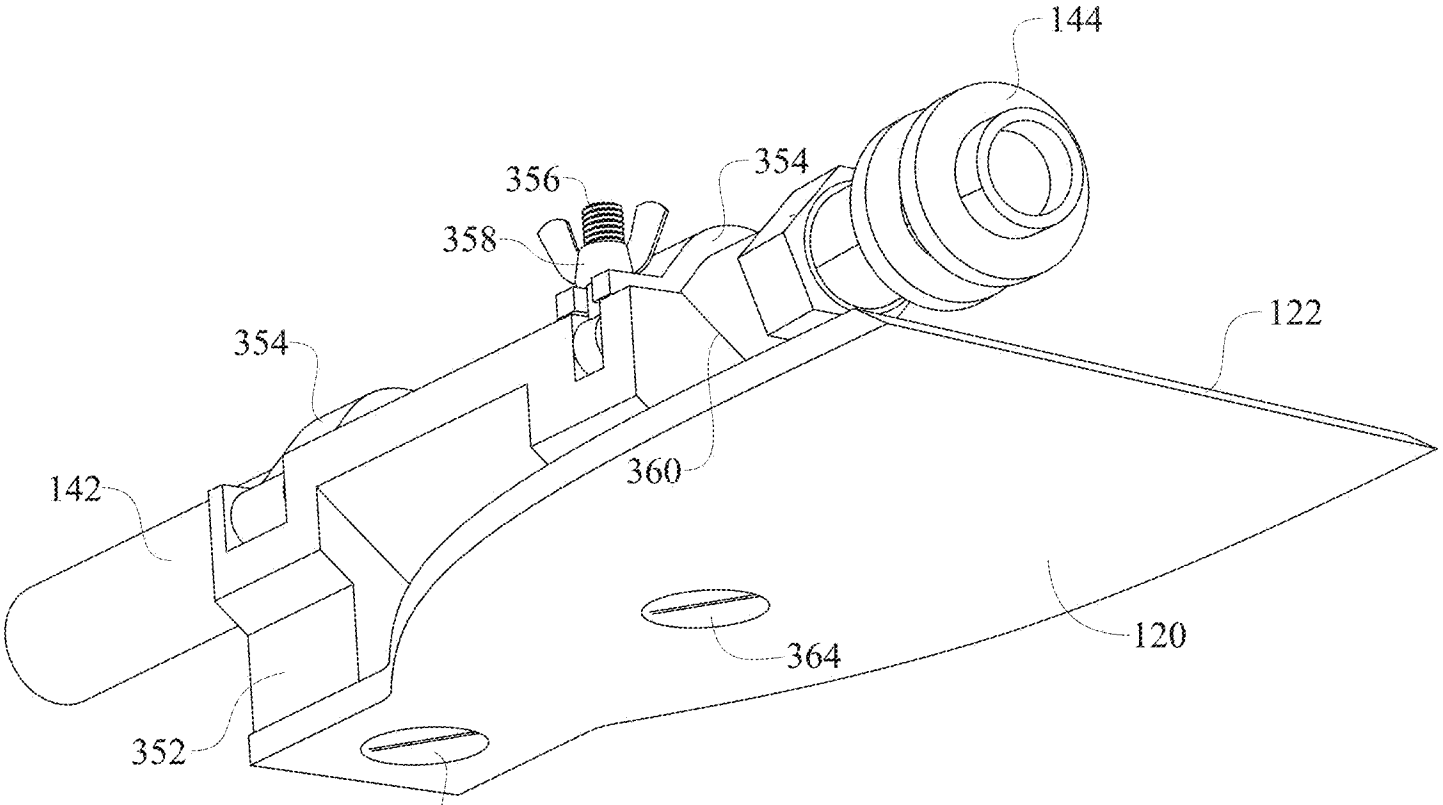
FIG. 38 presents an isometric, bottom view of the scraping blade assembly of FIG. 34.
Figure 39:
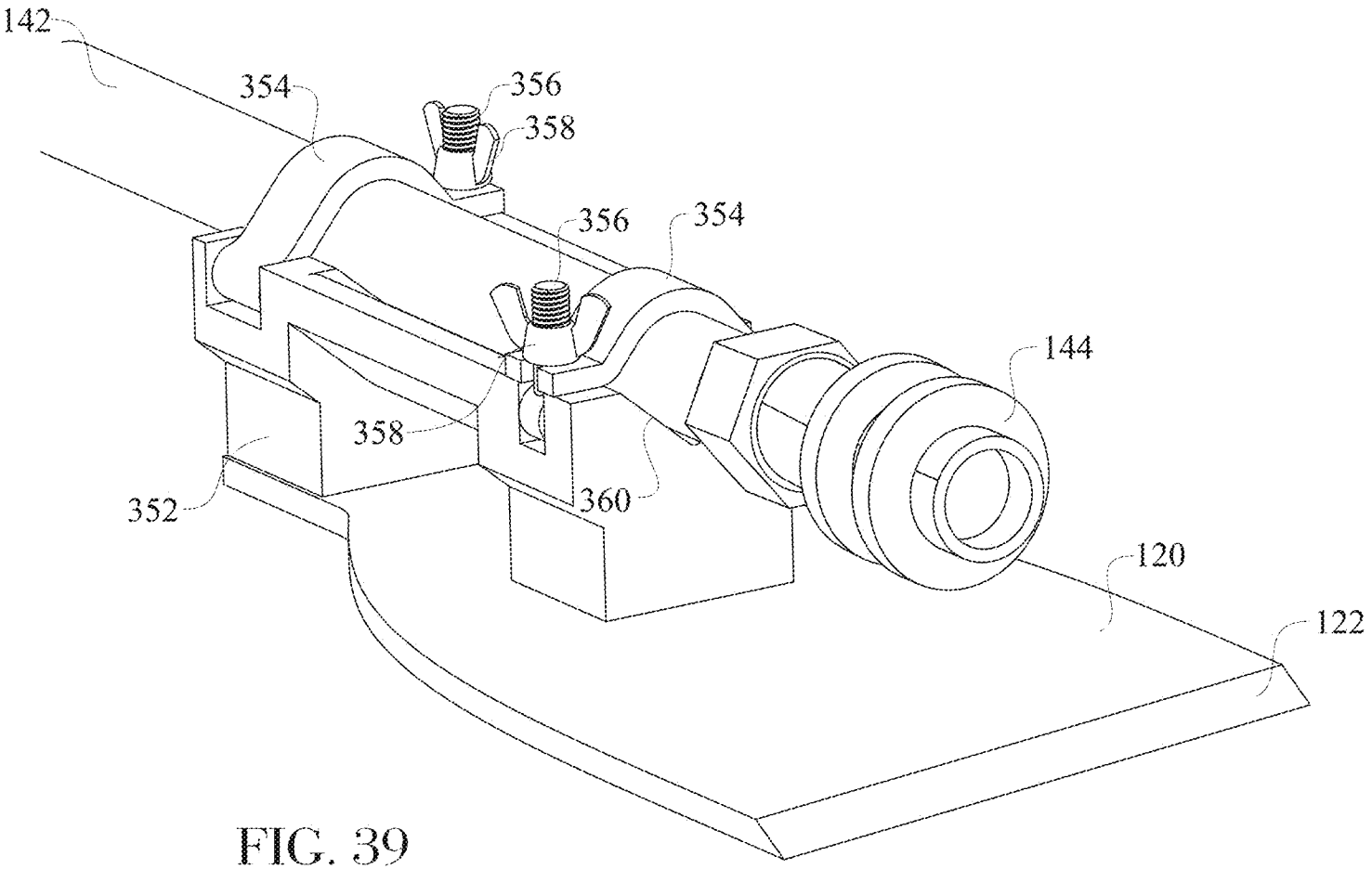
FIG. 39 presents an isometric, top view of the scraping blade assembly of FIG. 34 presenting the blade assembly being secured to the pressure cleaning wand.
Figure 41:
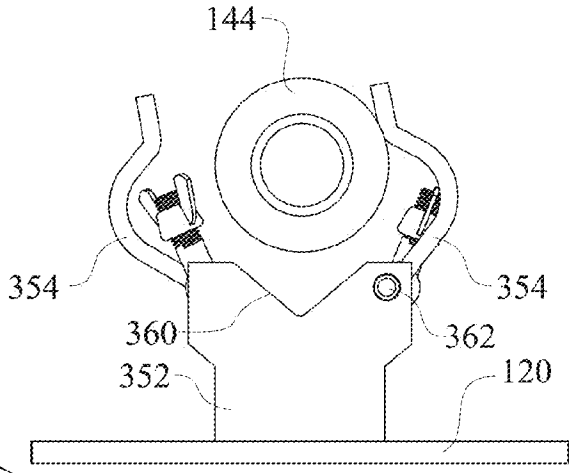
FIG. 41 presents a front view of the scraping blade assembly of FIG. 34 presenting the blade assembly being released from the pressure-cleaning wand.
Figure 40:
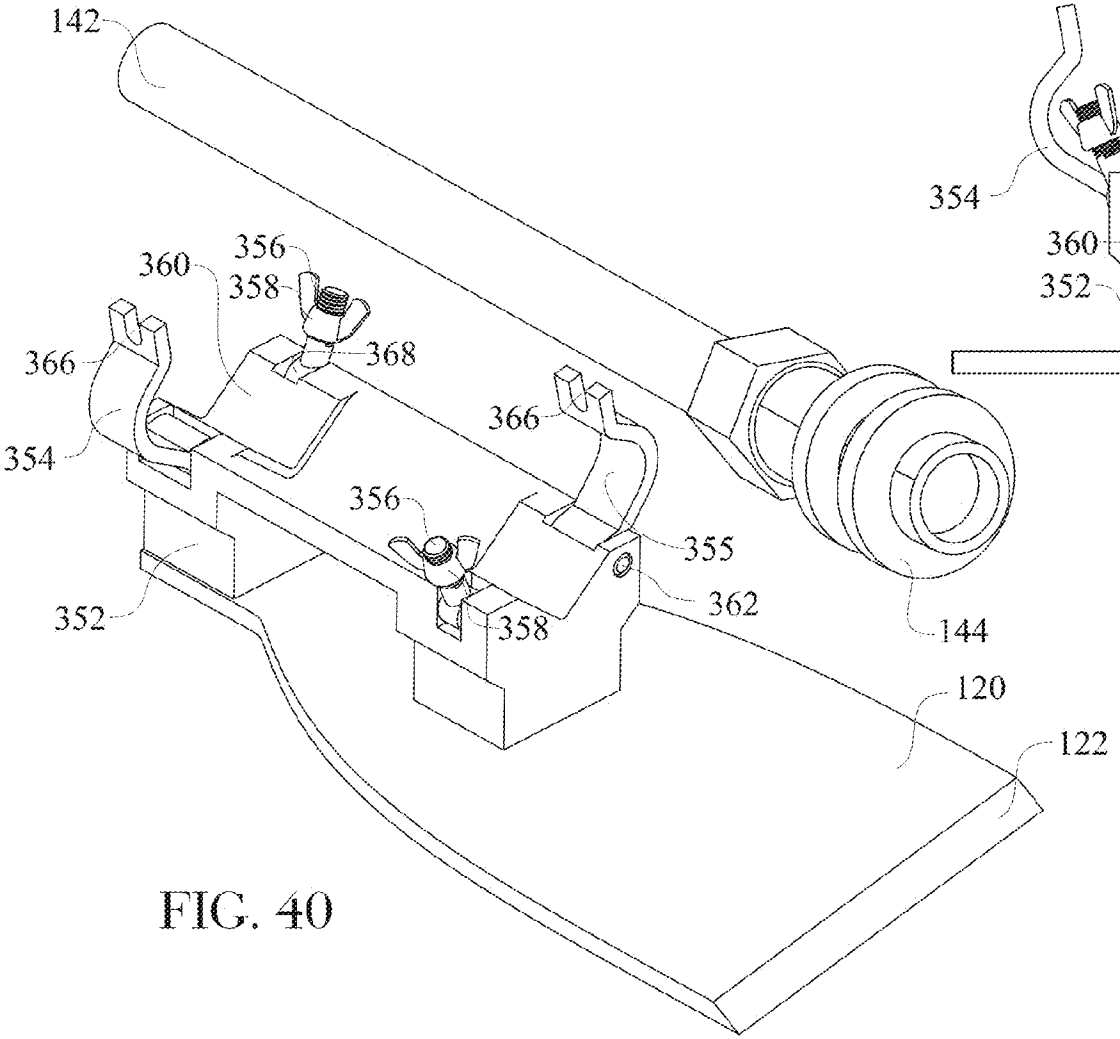
FIG. 40 presents an isometric, top view of the scraping blade assembly of FIG. 34 presenting the blade assembly being released from the pressure cleaning wand.

The present invention is furthered with the inclusion of a quick disconnect wand coupling assembly. Two exemplary embodiments are presented in the drawings. A quick release scraping apparatus 300 is presented in FIGS. 32 and 33. The quick release scraping apparatus 300 comprising the scraping blade 120 or a dual-edged blade 152 (presented earlier) assembled to a scraper spacing block 302 in accordance with the blade to body assembly configurations previously presented. The pressure sprayer extension pipe 142 is secured to the scraper spacing block 302 by placing the pressure sprayer extension pipe 142 against a sprayer pipe receiving surface 312, rotating each wand clamping hook 304 such to straddle the top of the pressure sprayer extension pipe 142, then applying a securing motion 320 to a mixed-thread locking cam 308. The mixed-thread locking cam 308 is assembled between a reverse threaded rod 306 and a standard threaded rod 307. The reverse threaded rod 306 is a threaded rod having standard oriented threads. The standard threaded rod 307 is a threaded rod having reverse oriented threads. The mixed thread-locking cam 308 is a threaded fastener having both standard oriented threads at a first end and reverse oriented threads at the opposing end. The threaded clamping assembly is assembled to the scraper spacing block 302 via a clamp anchor 314. When the mixed thread-locking cam 308 is rotated in accordance with the securing motion 320, the motion applies a reverse thread clamping force 322 and a standard thread clamping force 324. The clamping tension can be adjusted by rotating the various threaded components 306, 307 prior to positioning the pressure sprayer extension pipe 142. It is desirable to include a textured surface on the contacting area of the wand-clamping hook 304. At least one block aperture 316 of any shape as previously presented can be incorporated into the scraper spacing block 302 to reduce weight.

A quick release scraping apparatus 350 is presented in FIGS. 34 through 41. The quick release scraping apparatus 350 comprising the scraping blade 120 or a dual-edged blade 152 (presented earlier) assembled to a scraper spacing block 352 in accordance with the blade to body assembly configurations previously presented. The pressure sprayer extension pipe 142 is positioned onto a sprayer pipe receiving surface 360 of the scraper spacing block 352. A plurality of clamping arms 354 is pivotally assembled to the scraper spacing block 352 via a clamping arm hinge pin 362. A threaded locking member 356 is assembled to the scraper spacing block 352 via a locking member hinge 368 as a means for securing the clamping arm 354 about the pressure sprayer extension pipe 142. The clamping arm 354 is rotated over the pressure sprayer extension pipe 142 and the threaded locking member 356 is rotated into a clamping arm latching fork 366 of the clamping arm 354. A wing nut fastener 358 is threaded onto the threaded locking member 356 and subsequently tightened, thus applying a clamping force onto the pressure sprayer extension pipe 142. A arm clamping surface 355 can have a textured surface, ridges, a secondary material, and the like to increase the friction between the arm clamping surface 355 and the pressure sprayer extension pipe 142. The orientation of the clamping arms and fasteners can be either opposite as illustrated or parallel, placing the threaded locking member 356 proximate the same edge of the scraper spacing block 352. The embodiment illustrated presents a scraper spacing block 352 having two legs and an open section. It is understood the shape of the scraper spacing block 352 other than the specific features presented can be of a designer's choice.

Figure 42:
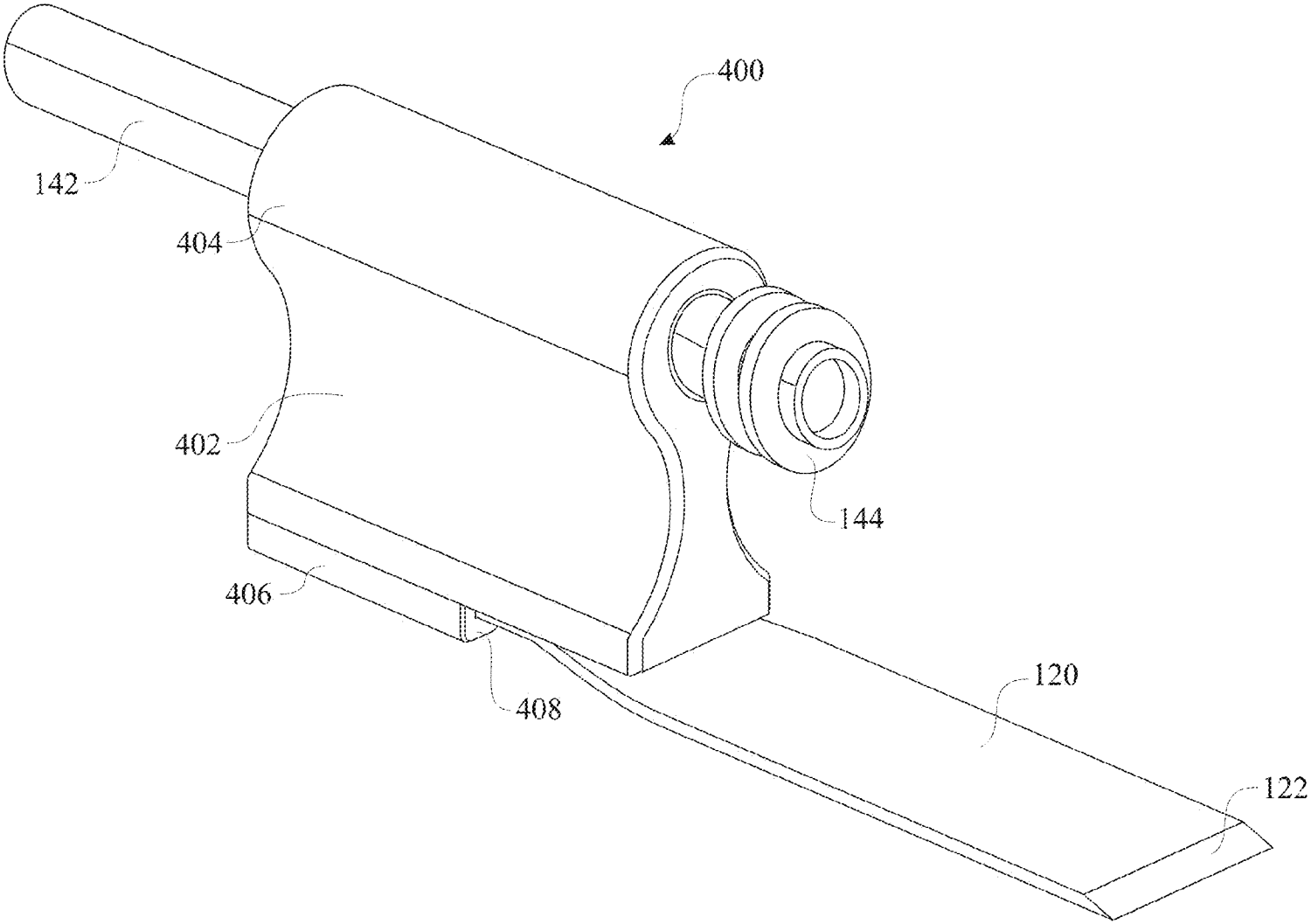
FIG. 42 presents an isometric view of an alternate embodiment providing a pressure flow port through a scraping block housing.
Figure 43:
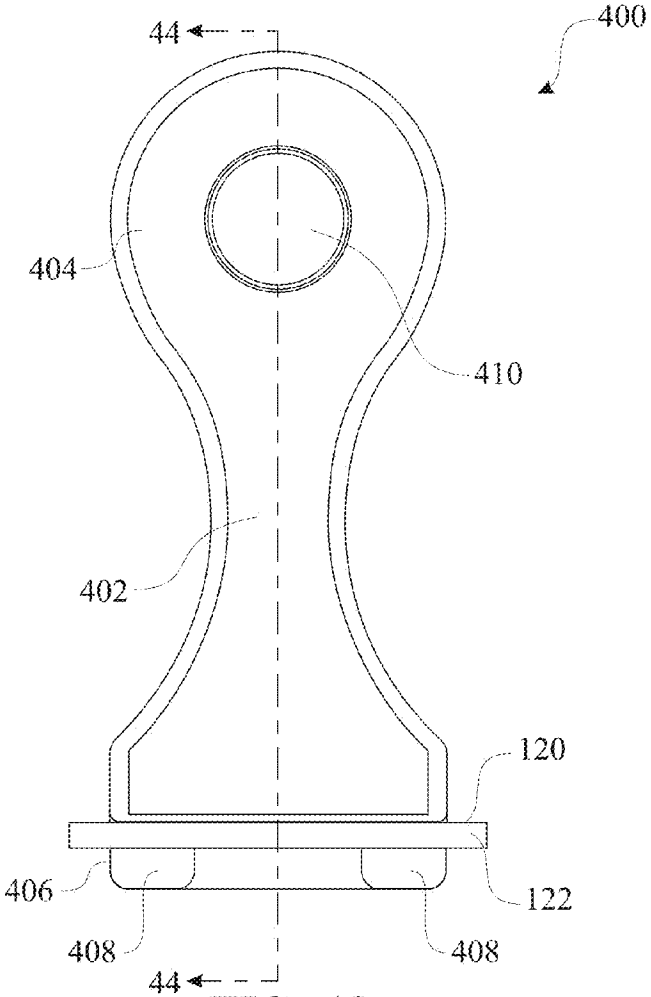
FIG. 43 presents a front view of the alternate embodiment of the scraping blade assembly of FIG. 42.
Figure 44:
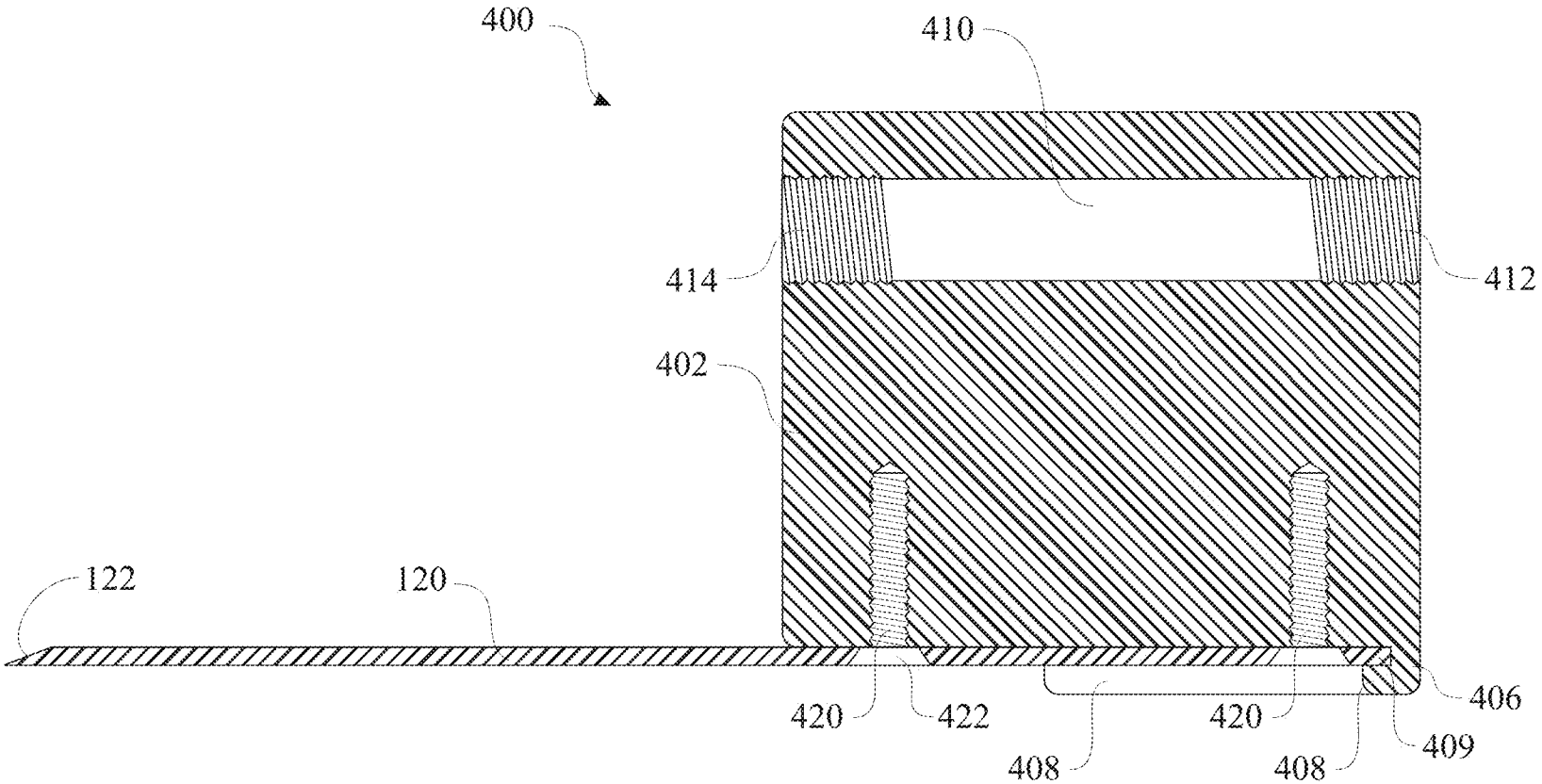
FIG. 44 presents a sectioned view of the alternate embodiment of the scraping blade assembly taken about section 44-44 of FIG. 43.
Figure 45:
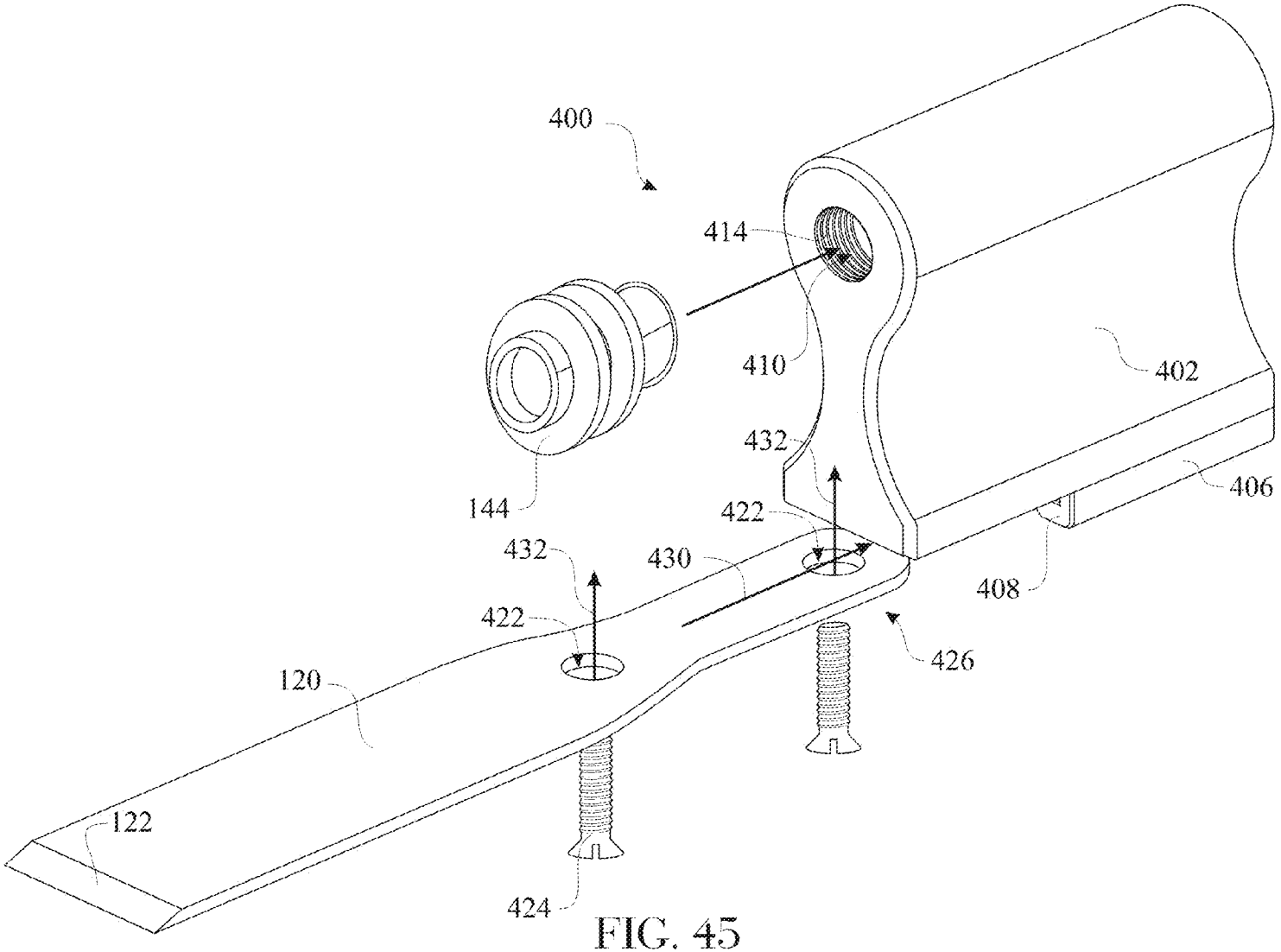
FIG. 45 presents an isometric exploded view of the scraping blade assembly of FIG. 42.

An alternate embodiment of a scraping blade assembly, referred to as 400, is presented in FIGS. 42 through 45. An isometric view is illustrated in FIG. 42, with an exploded assembly view shown in FIG. 45. A frontal view is presented in FIG. 43, with a sectional view along a longitudinal centerline being shown in FIG. 44.

A scraper spacing block 402 provides the main structure for the contiguous flow scraping apparatus 400. A fluid conduit section 404 is configured at an upper portion of the scraper spacing block 402, the fluid conduit section 404 includes a fluid conduit 410 bored lengthwise through the fluid conduit section 404. A spray pipe coupler 412 is formed at a fluid entry end of the fluid conduit 410 and a nozzle coupler 414 is formed at a fluid exiting end of the fluid conduit 410. The spray pipe coupler 412 provides a removable coupling between the scraper spacing block 402 and the pressure sprayer extension pipe 142. The present invention provides an apparatus that can easily be assembled to an existing pressure sprayer extension pipe 142 without any modifications. The nozzle coupler 414 provides a removable coupling between the scraper spacing block 402 and the spray nozzle 144. The present invention provides an apparatus that is user friendly for exchanging the spray nozzle 144. While the illustration presents a threaded coupling for each of the spray pipe coupler 412 and nozzle coupler 414, it is understood a quick disconnect or other coupling can be alternately incorporated therein.

The scraping blade 120 can be assembled to the scraper spacing block 402 in any manner, such as those described previously herein. The exemplary embodiment teaches yet another mounting means for the blade 120. In the exemplary embodiment, the scraping blade 120 and scraper spacing block 402 are assembled via a sliding motion 430. A blade mounting portion 426 of the scraping blade 120 is inserted into a blade seating undercut 409. The blade seating undercut 409 is preferably being in a "U" shape and formed via an undercut within a blade mounting flange 408 of a blade mounting section 406. The scraping blade 120 is then secured via insertion 432 of blade mounting screws 424. The screws 424 are inserted through a mounting aperture 422 provided vertically through the scraping blade 120, then threaded into threaded receptacles 420 formed within the scraper spacing block 402. The mounting aperture 422 can optionally include a countersunk feature as illustrated for recessing the head portion of the mounting screws 424. The blade seating undercut 409 provides vertical as well as torsional rigidity. A rear portion of the blade mounting section 406 can be placed in communication with the rear edge of the blade, countering any rearward forces resulting from the scraping process.

The contiguous flow scraping apparatus 400 provides several enhancements for a scraping apparatus and pressure cleaner. When using a quick disconnect (or similar connection interface), the scraper spacing block 402 can pivot about the pressure sprayer extension pipe 142 ensuring the blade edge 122 remains parallel with the contacted surface. The nozzle coupler 414 provides an easy means of interchanging pressure nozzles 144 or nozzle extensions (not shown but understood).

Figure 46:
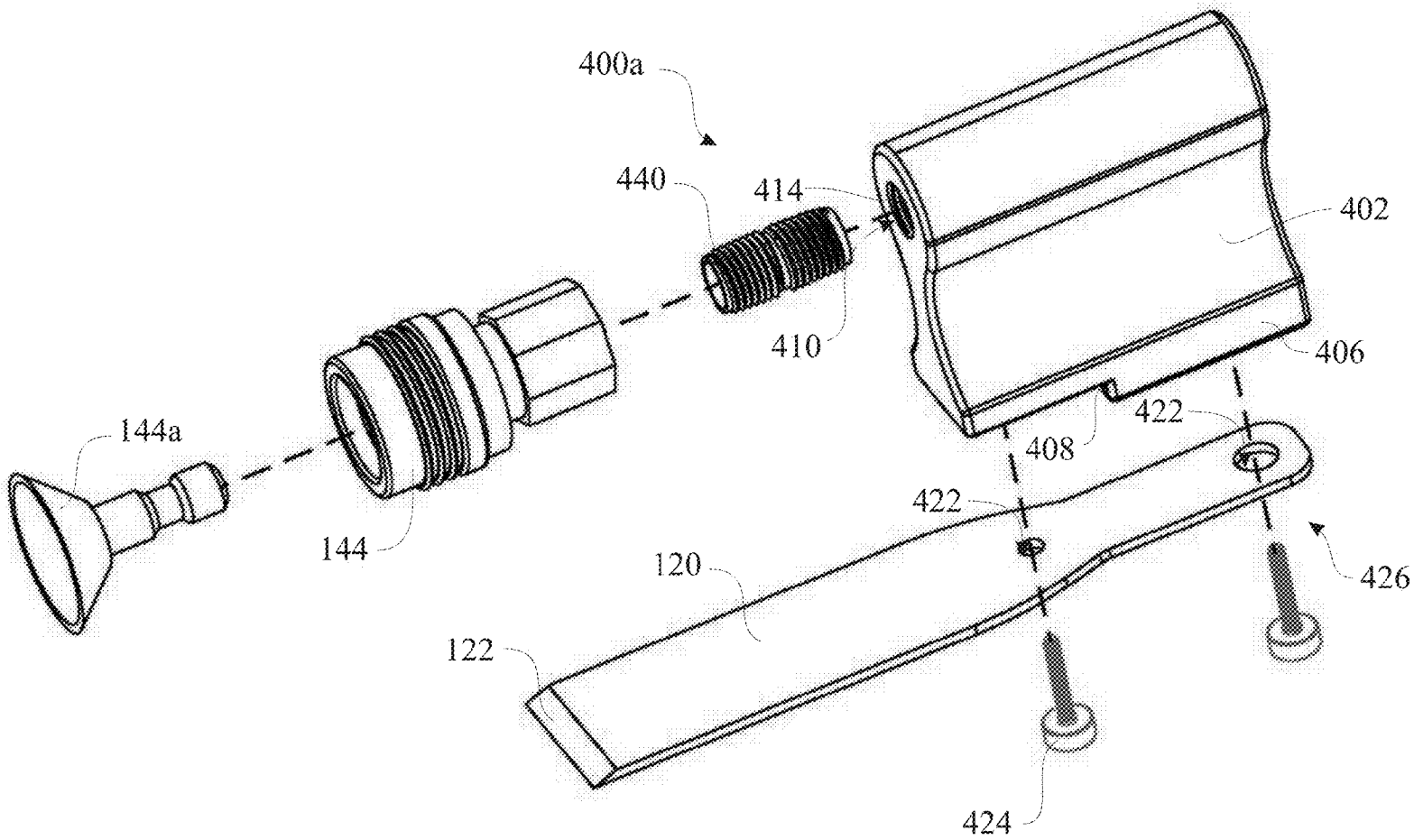
FIG. 46 presents an isometric exploded view of a modified version of the scraping blade assembly of FIG. 42.
Figure 47:
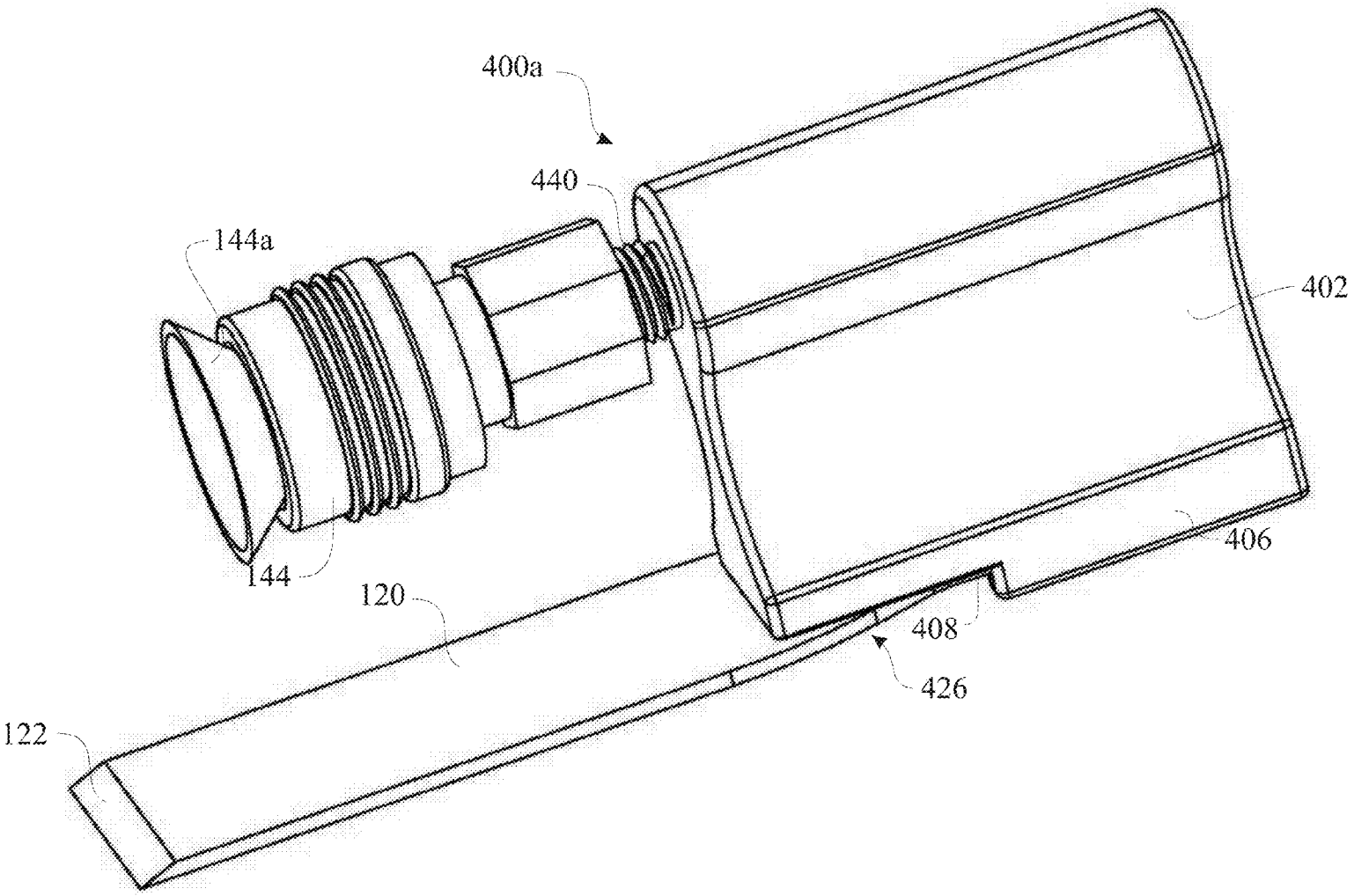
FIG. 47 presents an isometric assembled view of the modified version of the scraping blade assembly of FIG. 46.

A modified version of scraping blade assembly, referred to as 400*a*, is presented in FIGS. 46 and 47. An exploded assembly view is illustrated in FIG. 46, with an assembled view shown in FIG. 47. The scraping blade assembly 400*a* incorporates a nipple extension 440 inserted coupling the scraper spacing block 402 and the spray nozzle 144. The nipple extension 440 can be of various lengths, providing adjustment to the position of the spray nozzle 144. The nipple extension 440 can be of various coupling form factors, such as threading, quick disconnect, and the like. A spray control tip 144*a* can be assembled as a subcomponent of the spray nozzle 144 or separate member. The spray control tip 144*a* can be interchangeable providing a variety of spray discharges.

As variations, combinations and modifications may be made in the construction and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but defined in accordance with the foregoing claims appended hereto and their equivalents. By way of example, it will be well understood by those skilled in the art that the entire scraper spacing block can be provided integrally molded to the wand shaft of a new high-pressure wand, in lieu of providing a separately attachable spacer block.

What is claimed is:

1. A scraping apparatus assembly for use with a pressure cleaning assembly comprising a pressure cleaning wand and a nozzle for emitting a fluid to remove debris from a planar work surface, the scraping apparatus assembly comprising:

a scraping blade fabricated of a planar material, the scraping blade comprising a scraping section located at a first end thereof and a planar mounting section located at a second, opposite end thereof, the scraping blade defined having a first material edge and a second material edge, wherein the first material edge and a second material edge are located opposite one another, the scraping section having a linear blade edge formed along the first material edge thereof and the planar mounting section extending inward from the second material edge, wherein the linear blade edge comprises a chisel edge, said chisel edge extends generally perpendicular to a longitudinal axis of the scraping blade;

a scraping apparatus spacer block having a pipe connection section provided along an upper portion of the scraping apparatus spacer block that is parallel to a longitudinal axis of the pressure cleaning wand and a planar blade-engaging receiving surface provided on a lower portion of the scraping apparatus spacer block that is oriented tangential to a radial direction of the pressure cleaning wand, wherein the scraping apparatus spacer block provides a spatial arrangement between the pipe connection section and the planar blade receiving surface for maintaining the wand and the scraping blade in spaced-apart relationship to one another;

wherein the scraping blade planar mounting section is removably assembled to the planar blade-engaging receiving surface locating the second material edge proximate a respective end of the planar blade-engaging receiving surface and oriented with the blade edge extending forward from the scraping apparatus space block, wherein the assembly between the scraping blade planar mounting section and the planar blade-engaging receiving surface orients the scraping blade tangentially to the radius of the pressure cleaning wand;

wherein the pipe connection section is configured to be connected with the pressure cleaning assembly; and wherein, during use, the spacer block maintains the planar blade between the wand nozzle and the planar work surface, the planar surface of the scraping blade is oriented tangentially to the radius of the pressure cleaning wand, and the scraping edge of the scraping blade is oriented substantially perpendicular to the longitudinal axis of the pressure cleaning wand.

2. A scraping apparatus assembly as recited in claim 1, the scraping apparatus assembly further comprising a threaded fastener to secure the scraping blade planar mounting section and the planar blade-engaging receiving surface.

3. A scraping apparatus assembly as recited in claim 1, the scraping apparatus assembly further comprising at least one a threaded fastener inserted through a securing member aperture provided through the scraping blade planar mounting section and threadably engages with a threaded section provided within the spacer block.

4. A scraping apparatus assembly as recited in claim 1, the scraping apparatus assembly further comprising an "L" shaped section extending along each edge of the scraping blade planar mounting section forming a receiving channel to receive and retain the scraping blade planar mounting section and the planar blade-engaging receiving surface.

5. A scraping apparatus assembly as recited in claim 1, the scraping apparatus assembly locates the spray nozzle at a position between the blade edge and a respective end of the spacer block.

6. A scraping apparatus assembly as recited in claim 1, a span of the scraping blade between the blade edge and the second material edge is planar.

7. A scraping apparatus assembly as recited in claim 1, wherein a lower surface of the scraping apparatus assembly is planar.

8. A scraping apparatus assembly for use with a pressure cleaning assembly comprising a pressure cleaning wand and a nozzle for emitting a fluid to remove debris from a planar work surface, the scraping apparatus assembly comprising:

a scraping blade fabricated of a planar material, the scraping blade comprising a scraping section located at a first end thereof and a planar mounting section located at a second, opposite end thereof, the scraping blade defined having a first material edge and a second material edge, wherein the first material edge and a second material edge are located opposite one another, the scraping section having a linear blade edge formed along the first material edge thereof and the planar mounting section extending inward from the second material edge, wherein the linear blade edge comprises a chisel edge, said chisel edge extends generally perpendicular to a longitudinal axis of the scraping blade;

a scraping apparatus spacer block having a pipe connection section provided along an upper portion of the scraping apparatus spacer block that is parallel to a longitudinal axis of the pressure cleaning wand and a planar blade-engaging receiving surface provided on a lower portion of the scraping apparatus spacer block that is oriented tangential to a radial direction of the pressure cleaning wand, wherein the scraping apparatus spacer block provides a spatial arrangement between the pipe connection section and the planar blade receiving surface for maintaining the wand and the scraping blade in spaced-apart relationship to one another;

wherein the scraping blade planar mounting section is removably assembled to the planar blade-engaging receiving surface locating the second material edge proximate a respective end of the planar blade-engaging receiving surface and oriented with the blade edge extending forward from the scraping apparatus space block, wherein the assembly between the scraping blade planar mounting section and the planar blade-engaging receiving surface orients the scraping blade tangentially to the radius of the pressure cleaning wand;

wherein the blade edge is perpendicular to a longitudinal axis of the scraping blade;

wherein the pipe connection section is configured to be connected with the pressure cleaning assembly; and wherein, during use, the spacer block maintains the planar blade between the wand nozzle and the planar work surface, the planar surface of the scraping blade is oriented tangentially to the radius of the pressure cleaning wand, and the scraping edge of the scraping blade is oriented perpendicular to the longitudinal axis of the pressure cleaning wand.

9. A scraping apparatus assembly as recited in claim 8, the scraping apparatus assembly further comprising a threaded fastener to secure the scraping blade planar mounting section and the planar blade-engaging receiving surface.

10. A scraping apparatus assembly as recited in claim 8, the scraping apparatus assembly further comprising at least one a threaded fastener inserted through a securing member aperture provided through the scraping blade planar mounting section and threadably engages with a threaded section provided within the spacer block.

11. A scraping apparatus assembly as recited in claim 8, the scraping apparatus assembly further comprising an "L" shaped section extending along each edge of the scraping blade planar mounting section forming a receiving channel to receive and retain the scraping blade planar mounting section and the planar blade-engaging receiving surface.

12. A scraping apparatus assembly as recited in claim 8, the scraping apparatus assembly locates the spray nozzle at a position between the blade edge and a respective end of the spacer block.

13. A scraping apparatus assembly as recited in claim 8, a span of the scraping blade between the blade edge and the second material edge is planar.

14. A scraping apparatus assembly as recited in claim 8, wherein a lower surface of the scraping apparatus assembly is planar.

15. A scraping apparatus assembly for use with a pressure cleaning assembly comprising a pressure cleaning wand and a nozzle for emitting a fluid to remove debris from a planar work surface, the scraping apparatus assembly comprising:

a scraping blade fabricated of a planar material, the scraping blade comprising a scraping section located at a first end thereof and a planar mounting section located at a second, opposite end thereof, the scraping blade defined having a first material edge and a second material edge, wherein the first material edge and a second material edge are located opposite one another, the scraping section having a linear blade edge formed along the first material edge thereof and the planar mounting section extending inward from the second material edge, wherein the linear blade edge comprises a chisel edge, said chisel edge extends at a an angle away from being perpendicular to a longitudinal axis of the scraping blade;

a scraping apparatus spacer block having a pipe connection section provided along an upper portion of the scraping apparatus spacer block that is parallel to a longitudinal axis of the pressure cleaning wand and a planar blade-engaging receiving surface provided on a lower portion of the scraping apparatus spacer block that is oriented tangential to a radial direction of the pressure cleaning wand, wherein the scraping apparatus spacer block provides a spatial arrangement between the pipe connection section and the planar blade receiving surface for maintaining the wand and the scraping blade in spaced-apart relationship to one another;

wherein the scraping blade planar mounting section is removably assembled to the planar blade-engaging receiving surface locating the second material edge proximate a respective end of the planar blade-engaging receiving surface and oriented with the blade edge extending forward from the scraping apparatus space block, wherein the assembly between the scraping blade planar mounting section and the planar blade-engaging receiving surface orients the scraping blade tangentially to the radius of the pressure cleaning wand;

wherein the blade edge is formed at an angle away from being perpendicular to a longitudinal axis of the scraping blade;

wherein the pipe connection section is configured to be connected with the pressure cleaning assembly; and wherein, during use, the spacer block maintains the planar blade between the wand nozzle and the planar work surface, the planar surface of the scraping blade is oriented tangentially to the radius of the pressure cleaning wand, and the scraping edge of the scraping blade is oriented at an angle away from perpendicular to the longitudinal axis of the pressure cleaning wand.

16. A scraping apparatus assembly as recited in claim 15, the scraping apparatus assembly further comprising a threaded fastener to secure the scraping blade planar mounting section and the planar blade-engaging receiving surface.

17. A scraping apparatus assembly as recited in claim 15, the scraping apparatus assembly further comprising at least one a threaded fastener inserted through a securing member aperture provided through the scraping blade planar mounting section and threadably engages with a threaded section provided within the spacer block.

18. A scraping apparatus assembly as recited in claim 15, the scraping apparatus assembly further comprising an "L" shaped section extending along each edge of the scraping blade planar mounting section forming a receiving channel to receive and retain the scraping blade planar mounting section and the planar blade-engaging receiving surface.

19. A scraping apparatus assembly as recited in claim 15, the scraping apparatus assembly locates the spray nozzle at a position between the blade edge and a respective end of the spacer block.

20. A scraping apparatus assembly as recited in claim 15, a span of the scraping blade between the blade edge and the second material edge is planar.

* * * * *